US008961373B2

(12) United States Patent
Halver

(10) Patent No.: US 8,961,373 B2
(45) Date of Patent: Feb. 24, 2015

(54) SKATING SIMULATOR

(76) Inventor: Terrence Halver, Adams, MN (US)

( * ) Notice: Subject to any disclaimer, the term of this patent is extended or adjusted under 35 U.S.C. 154(b) by 1005 days.

(21) Appl. No.: 13/060,296

(22) PCT Filed: Aug. 26, 2009

(86) PCT No.: PCT/US2009/054996

§ 371 (c)(1),
(2), (4) Date: Feb. 23, 2011

(87) PCT Pub. No.: WO2010/027836

PCT Pub. Date: Mar. 11, 2010

(65) Prior Publication Data

US 2011/0152036 A1 Jun. 23, 2011

Related U.S. Application Data

(60) Provisional application No. 61/091,810, filed on Aug. 26, 2008.

(51) Int. Cl.
*A63B 22/04* (2006.01)

(52) U.S. Cl.
USPC ..... 482/51; 482/52; 482/57

(58) Field of Classification Search
USPC ..... 482/51, 70, 71, 83
See application file for complete search history.

(56) References Cited

U.S. PATENT DOCUMENTS

| | | | |
|---|---|---|---|
| 3,475,021 | A | 10/1969 | Ruegsegger |
| 3,941,377 | A | 3/1976 | Lie |
| 4,340,214 | A | 7/1982 | Schutzer |
| 4,376,532 | A | 3/1983 | Hunstad |
| 4,506,884 | A | 3/1985 | Hankin |
| 4,650,184 | A | 3/1987 | Brebner |
| 4,781,372 | A | 11/1988 | McCormack |
| 4,869,496 | A | 9/1989 | Colombo |
| 4,911,430 | A | 3/1990 | Flament |
| 4,915,373 | A | 4/1990 | Walker |
| 5,284,460 | A | 2/1994 | Miller et al. |
| 5,295,935 | A | 3/1994 | Wang |
| 5,328,427 | A | 7/1994 | Sleamaker |
| 5,391,130 | A | 2/1995 | Green et al. |
| 5,503,609 | A | 4/1996 | Bull |
| 5,520,598 | A | 5/1996 | Little |
| 5,718,658 | A | 2/1998 | Miller et al. |
| 5,989,163 | A | 11/1999 | Rodgers, Jr. |
| 6,042,511 | A | 3/2000 | Bulloch |
| 6,234,935 | B1 | 5/2001 | Chu |
| 6,514,180 | B1 | 2/2003 | Rawls |
| 2004/0097335 | A1 | 5/2004 | Chu |
| 2004/0248704 | A1 | 12/2004 | Rodgers, Jr. |

*Primary Examiner* — Glenn Richman
(74) *Attorney, Agent, or Firm* — Sherrill Law Offices, PLLC

(57) ABSTRACT

The invention is a skating simulator 10 having a frame 20, a longitudinally extending rail 30, a carriage 40, and a foot pedal 50. The rail 30 is attached to the frame 20. The carriage 40 operably engages the rail 30 for reciprocating along a path 60 along the rail 30. The foot pedal 50 is attached to the carriage 40. The foot pedal 50 has an intermediate member 51, a foot pad 52, means for attaching the foot pad 52 to the intermediate member 51 allowing non circular arcuate movement of the foot pad 52 in relation to the intermediate member 51 in the longitudinal direction X and transverse direction Z.

24 Claims, 18 Drawing Sheets

SKATING SIMULATOR

This application claims the benefit of U.S. Provisional Application No. 61/091,810, filed Aug. 26, 2008.

BACKGROUND

A skating simulator is a machine or device designed to assist an individual in simulating, in whole or in part, the act of skating. Previous attempts to re-create the skating motion have met with mixed results.

Over the years different inventors have approached the task of building a good skating simulator from a few different directions. Of the numerous patent filings in the area of machines intended to simulate skating or skiing they all fall into one of three or four basic categories. One such type is a Lateral Linear Motion Machine (LLMM). A LLMM is a machine designed to facilitate lateral travel across its surface. The individual using the LLMM abducts and adducts one or both hips while sliding laterally with one or both feet.

LLMMs can be divided into two categories as well. A Full Lateral Linear Motion Machine (FLLMM) is a machine that will allow an individual to slide sideways, in a linear (straight line) motion, from one side of a machine to the other. The individual using the machine will be able to bring both feet together at each end of the machine before sliding back to the opposite side. The individual will be sliding or rolling or by some other means traversing this machine on a rail, tracks, board, platform or some type of guide(s) in a straight line.

A Partial Lateral Linear Motion Machines (PLLMM) is a machine having much in common with the FLLMM's but with one very basic difference. Each foot is restricted to one side of the machine. Neither foot is able to move beyond the center line. When using a PLLMM it is not possible for the individual to bring his/her feet together at either end of the machine, or even bring his/her feet together even in the middle of the machine.

There are many FLLMM and PLLMM skating simulators that target different movements of the skating motion. These simulators cause the user's ankles to pronate or supinate as they move linearly along the track. The pronation and supination of the ankle seen in these simulators does not replicate the bio-mechanically correct position of the ankle throughout the skating stride during skating on ice. This unnatural movement of the ankle as the foot slides laterally can cause sore and/or bruised ankles or even serious injury. Additionally this unnatural movement forced upon the ankle in previous devices limits training options, decreases the value of training, and decreases the likelihood the training will transfer to on-ice performance.

Therefore a need exists for a skating simulator that more accurately simulates the entire skating movement of the user and allows the user's ankles to remain in the correct bio-mechanically correct position through out the full range of a skater's motion when using a training device.

SUMMARY OF THE INVENTION

A first aspect of the invention is a skating simulator having a frame, a longitudinally extending rail, a carriage, and a foot pedal. The rail is attached to the frame. The carriage operably engages the rail for reciprocating along a path along the rail. The foot pedal is attached to the carriage. The foot pedal has an intermediate member, a foot pad, means for attaching the foot pad to the intermediate member allowing non circular arcuate movement of the foot pad in relation to the intermediate member in the longitudinal and transverse directions.

A second aspect of the invention is a skating simulator foot pedal having an intermediate member, a foot pad, and means for attaching the foot pad to the intermediate member allowing non circular arcuate movement of the foot pad in relation to the intermediate member in the longitudinal and transverse directions.

A third aspect of the invention is a skating simulator foot pedal having an intermediate member, a foot pad, and a restriction link. The foot pad is pivotally attached to the intermediate member for pivoting about a primary lateral axis and reciprocating in the longitudinal direction relative to a secondary lateral axis. The restriction link is pivotally attached to the foot pad and pivotally attached to the intermediate member for pivoting about the secondary lateral axis.

DETAILED DESCRIPTION OF A PREFERRED EMBODIMENT

Definitions

Figure 1:
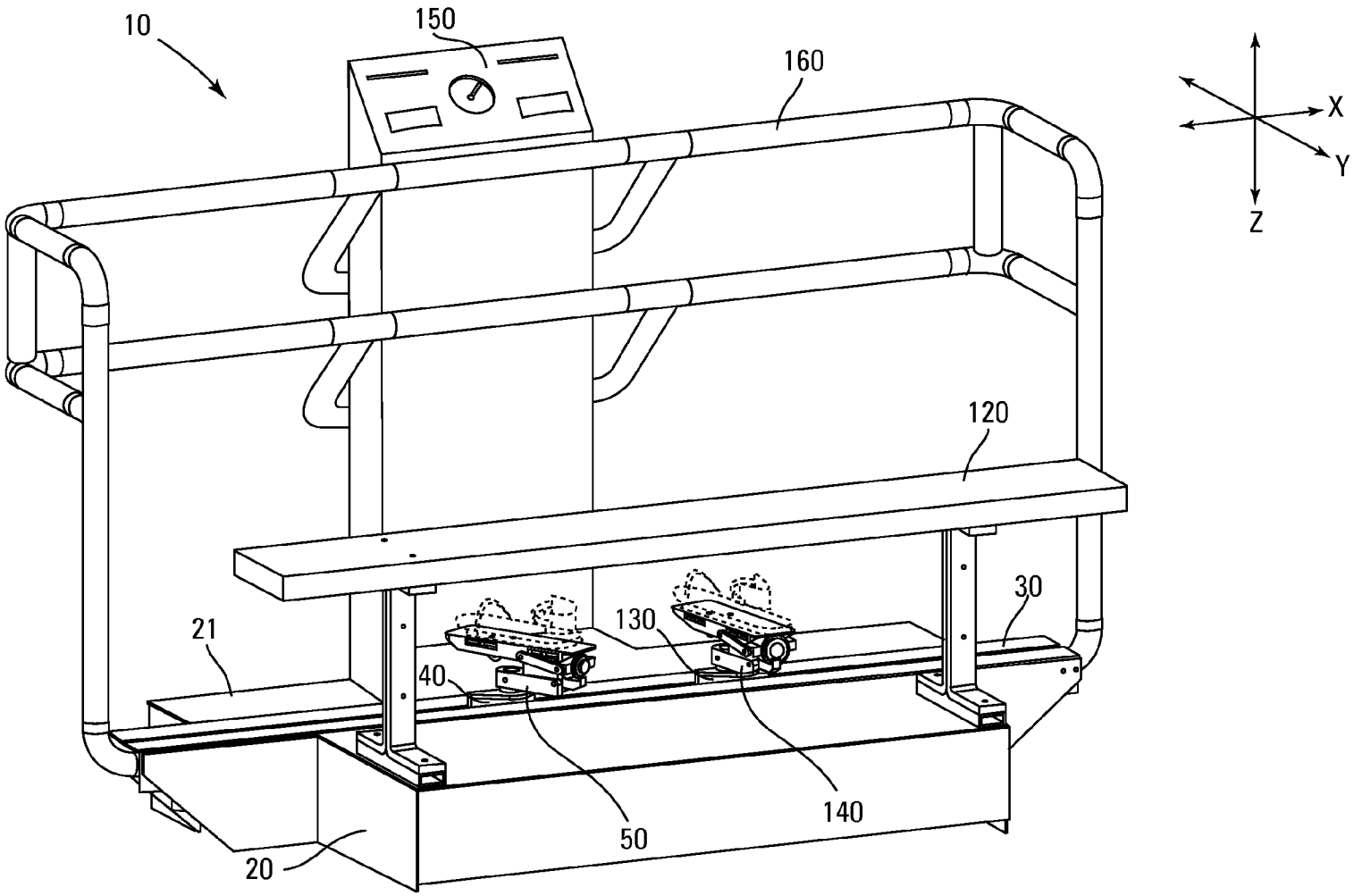
FIG. 1 is a front prospective view of one embodiment of the simulator with a first foot pedal and a second foot pedal on a first rail.

As utilized herein, including the claims, the phrase "neutral ankle," means an ankle in a position such that the foot is neither pronating nor supinating.

As utilized herein, including the claims, the term "pronating," means turning or rotating the foot by abduction and eversion so that the inner edge of the sole bears the body's weight.

As utilized herein, including the claims, the term "supinating," means turning or rotating the foot by adduction and inversion so that the outer edge of the sole bears the body's weight.

NOMENCLATURE

10 Simulator
20 Frame
21 Deck
30 First rail
40 First carriage
41 Wheels
42 Shoulder
43 Chamber
44 Shaft
45 Spring
50 First foot pedal
51 Intermediate member
52 Foot pad
52*a* Foot plate base
52*b* Foot plate
53 Base member
54 Restriction link
55 Foot binder
56 Toe end
57 Heel end
58 Magnetic attachment
60 Path
61 First direction
62 Second direction
70 Socket
80 Main frame assembly
81 First belt
82 First tension pulley
83 First corner pulley
84 Second corner pulley
85 First drive pulley
86 Drive shaft
87 First direction
88 Second direction
90 Momentum storage device
100 Stop
110 Shock assembly
111 Bumper
112 First push rod
113 Second push rod
114 Shock absorber
115 Face plate
116 Stabilizer plate
117 Spring
120 Bench
130 Second carriage
140 Second foot pedal
150 Control panel
160 Hand support
170 Variable resistance means
181 Second belt
182 Second tension pulley
183 Third corner pulley
184 Fourth corner pulley
185 Second drive pulley
200 Lead screw assembly
201 Lead screw
210 Shock assembly
211 Bumper
212 First push rod
213 Second push rod
214*a* Primary cylinder
214*b* Secondary cylinder
215 Face plate
216 Stabilizer plate
217 Spring
250 Foot pedal
251 Intermediate member
252 Foot pad
253 Opening
254 Cam
255 Cam roller
350 Foot pedal
351 Intermediate member
352 Foot pad
352*a* Toe end
352*b* Heel end
353 Restriction link
354 Cam
355 Cam roller
450 Foot pedal
451 Intermediate member
452 Foot pad
453 First link
454 Second link
X Longitudinal direction
Y Lateral direction
Z Transverse direction
$Z_1$ First transverse direction
$Z_2$ Second transverse direction
X1 Longitudinal axis
Y1 Primary lateral axis
Y2 Secondary lateral axis
Y3 Third lateral axis
$Y_A$ Lateral axis
Z1 Transverse axis Construction The skating simulator's 10 primary purpose is to allow an individual to closely simulate a broad range of movements associated with the act of skating (i.e. hockey skating, roller skating, figure skating, speed skating, ski skating and numerous other activities involving similar movements). The skating simulator 10 may allow training specific muscle groups most directly related to the skating motion. The extent to which a skater will benefit from strength, quickness, and endurance training is directly related to how effectively the training regimen replicates the act of skating and the specific muscles involved. By selectively altering resistance levels, stride length, foot pedal rotation and placement, users can custom tailor workouts for a variety of specific and desirable outcomes such as improve skating technique, increase strength, speed, quickness, and endurance on skates, reduce the risk of injury most prevalent among skaters, expedite the rehabilitation process when those injuries occur, provide general conditioning opportunity for athletes of all types. While the discussion focuses on skating, the simulator 10 can be used to provide workouts for any athlete.

Figure 2:
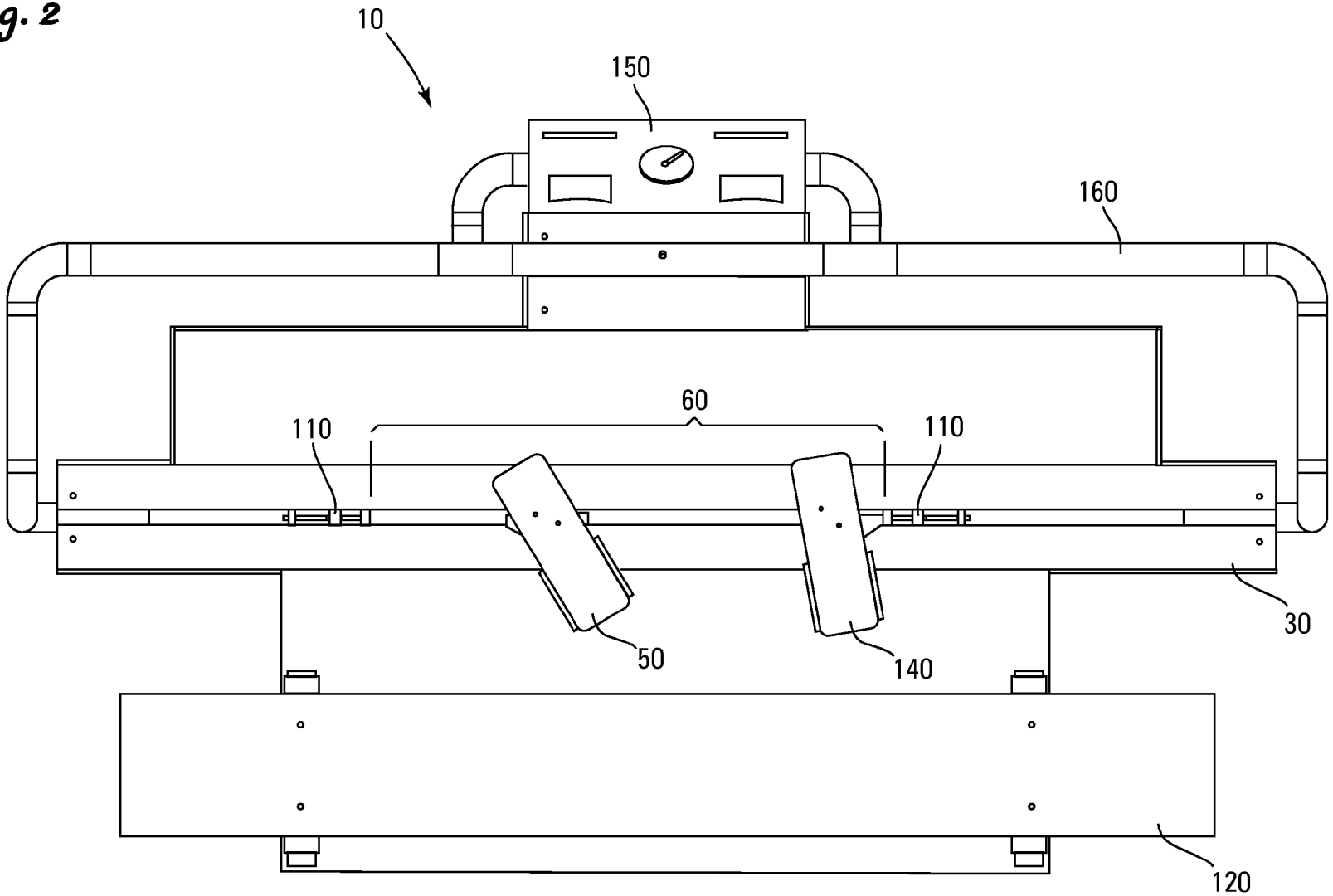
FIG. 2 is a top view of the simulator in FIG. 1.

As shown in FIGS. 1 and 2, the skating simulator 10 is comprised of a frame 20, a longitudinally extending first rail 30, a first carriage 40, and a first foot pedal 50. The frame 20 may be made from any suitable material such as wood, plastic or metal. The preferred material is aluminum and steel. Preferably the frame 20 may be covered with a deck 21. Preferably the deck 21 is made from aluminum plate tread or diamond decking and polished aluminum.

Figure 11:
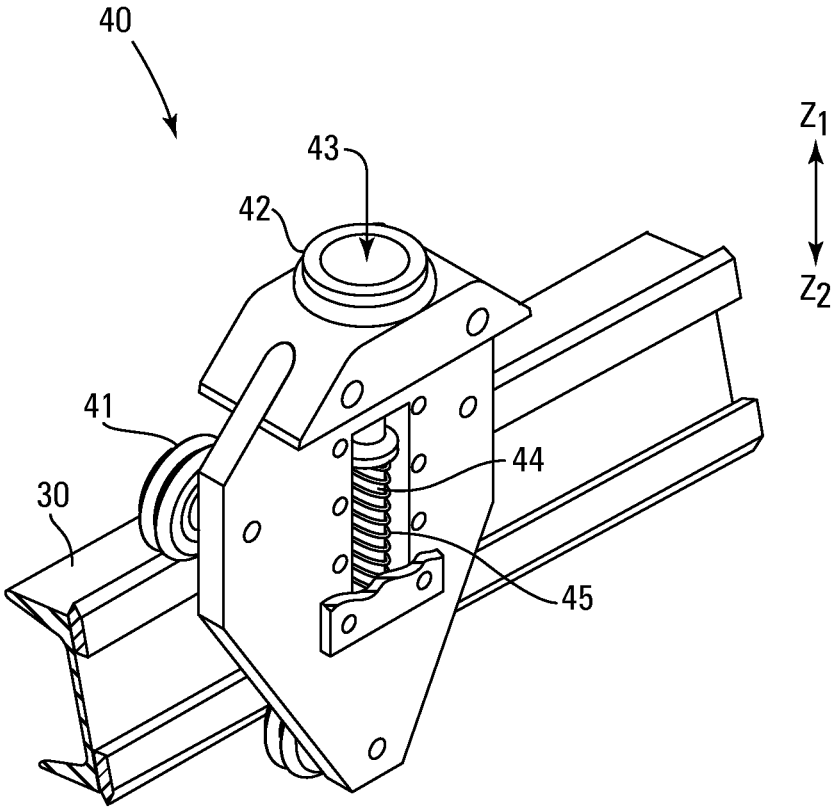
FIG. 11 is partial side perspective view of one embodiment of the first rail and the first carriage in FIG. 5.

The longitudinally extending first rail 30 is fixedly attached to the frame 20. The first rail 30 may be made from any suitable material such as metal, wood, or plastic. The preferred material is metal. As shown in FIG. 11 the preferred configuration of the first rail 30 is a piece of aluminum channel with dual V tracks installed on each side. Preferably the V tracks are steel or stainless steel. The first rail may be any suitable length (not numbered) that satisfies the exercise requirements of the user. Most preferably the first rail 30 is 6 foot long and the channel is 3 inches wide in the transverse direction. Preferably the tracks run parallel to each other the entire length of the channel.

A simulator 10 may also have a second rail (not shown) similar to the first rail 30. Preferably the second rail is configured and arranged to lie parallel to the first rail 30 and a lateral distance Y from the first rail 30. This second rail may be used for working muscles associated with the crossover or cross under skating motion. It also may allow users to simulate a variety of cross-country skiing motions.

Figure 3:
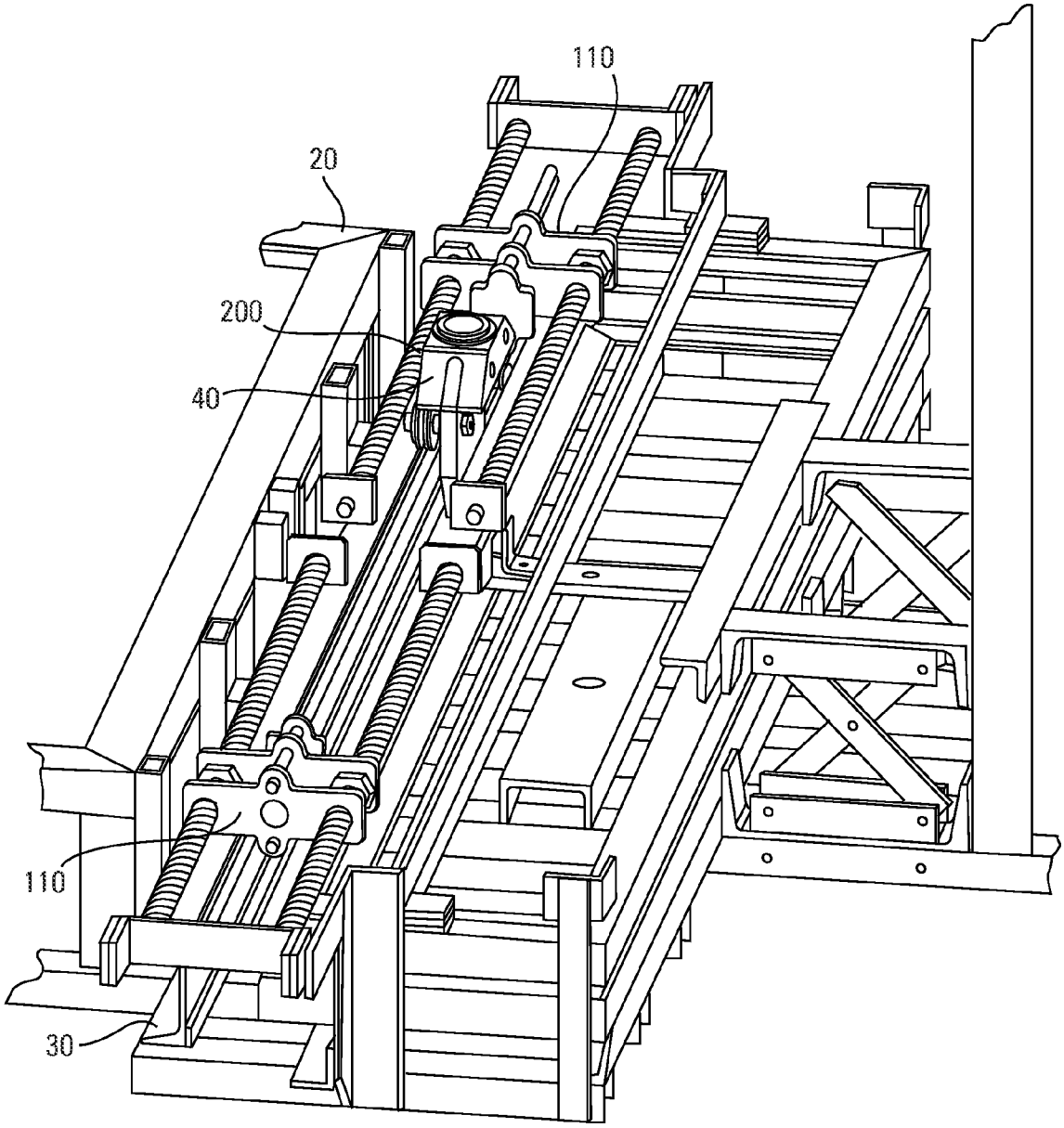
FIG. 3 is a partial side perspective view of the simulator in FIG. 1 with the foot pedals, railing and deck removed.
Figure 5:
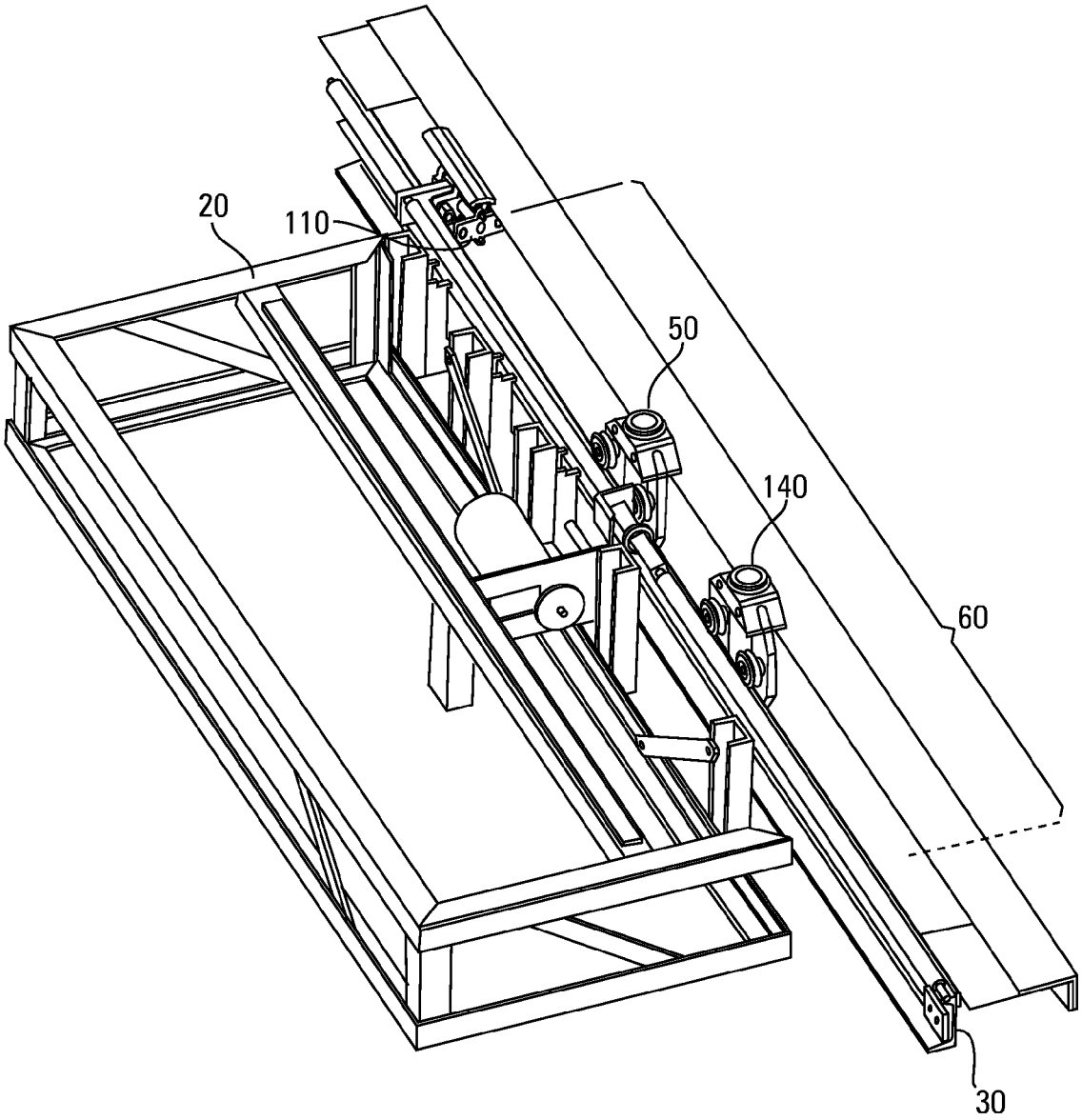
FIG. 5 is a partial top perspective view of the base of the simulator with the deck removed in FIG. 1 and the first rail, first and second carriages, and one shock assembly.
Figure 6:
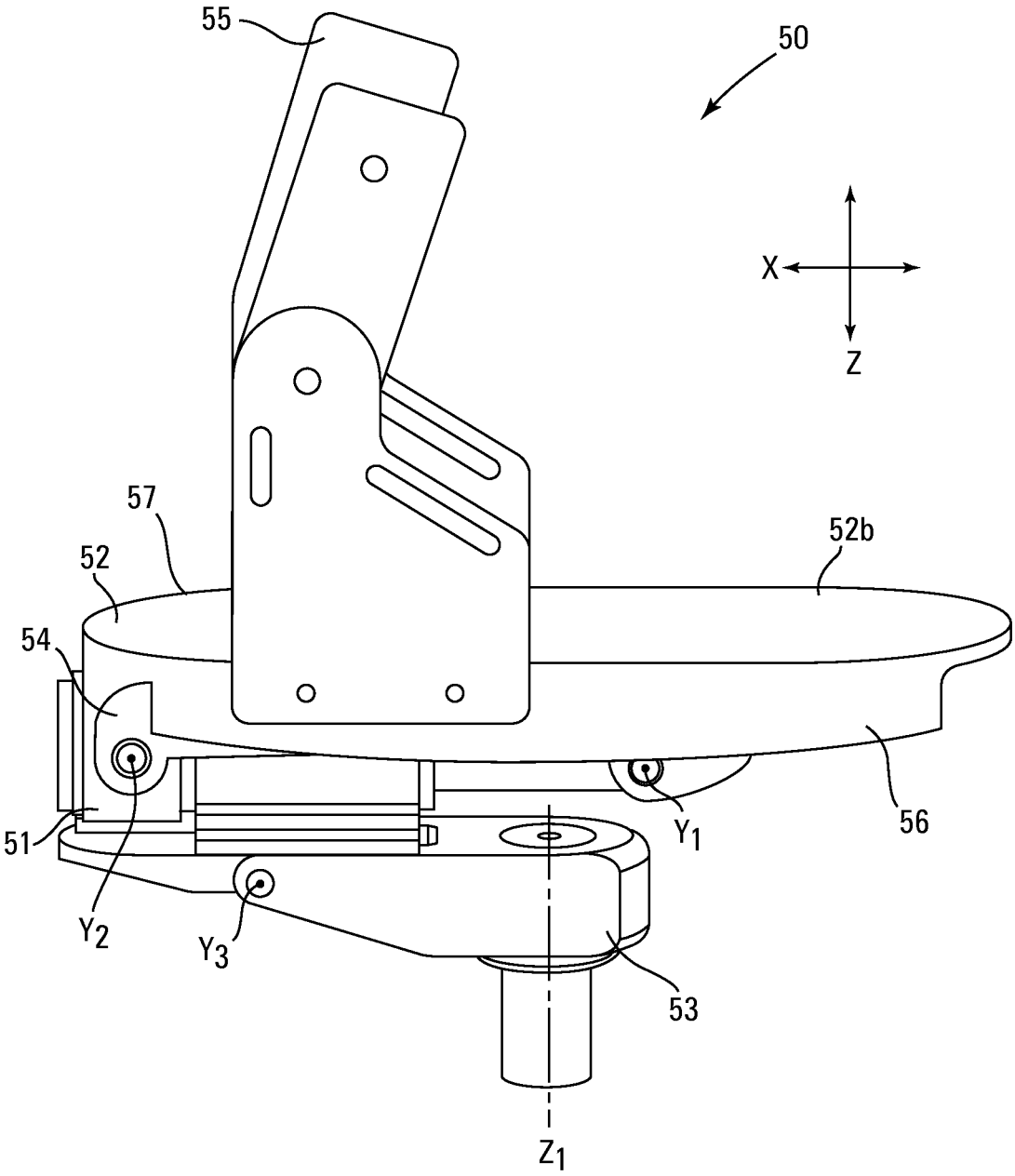
FIG. 6 is a side view of one embodiment of the foot pedal removeably attached to the simulator in FIG. 1.
Figure 19:
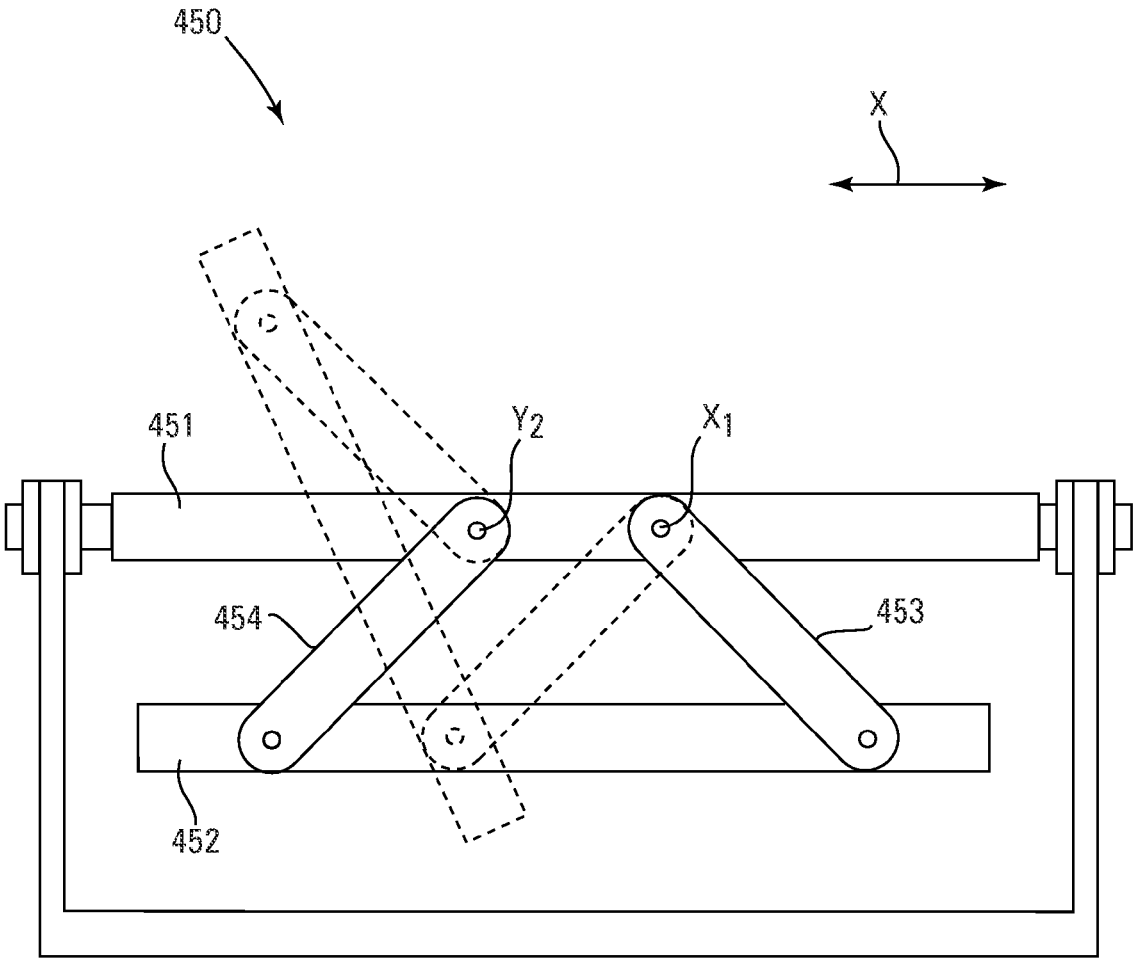
FIG. 19 is a partial side view of a fourth embodiment of the foot pedal.

As shown in FIGS. 3, 5 and 19, a first carriage 40 operably engages the first rail 30 for reciprocating along a path 60 along the first rail 30. Any suitable first carriage 40 may be used that engages the first rail and allowing reciprocating along a path 60 along the first rail 30. The preferred first carriage 40 is made of ⅝ inch thick aluminum and cut to minimize weight while maintaining strength. Preferably the first carriage 40 has at least 3 "V" grooved wheels 41 for operably engaging the first rail 30. Having a first carriage 40 with at least 3 "V" grooved wheels 41 in combination with the first rail 30 comprised of a channel with dual V tracks installed on each side may improve the first carriage's 40 stability in the transverse direction Z and lateral direction Y while allowing it to travel longitudinally X along the path 60 of the first rail 30.

Figure 10:
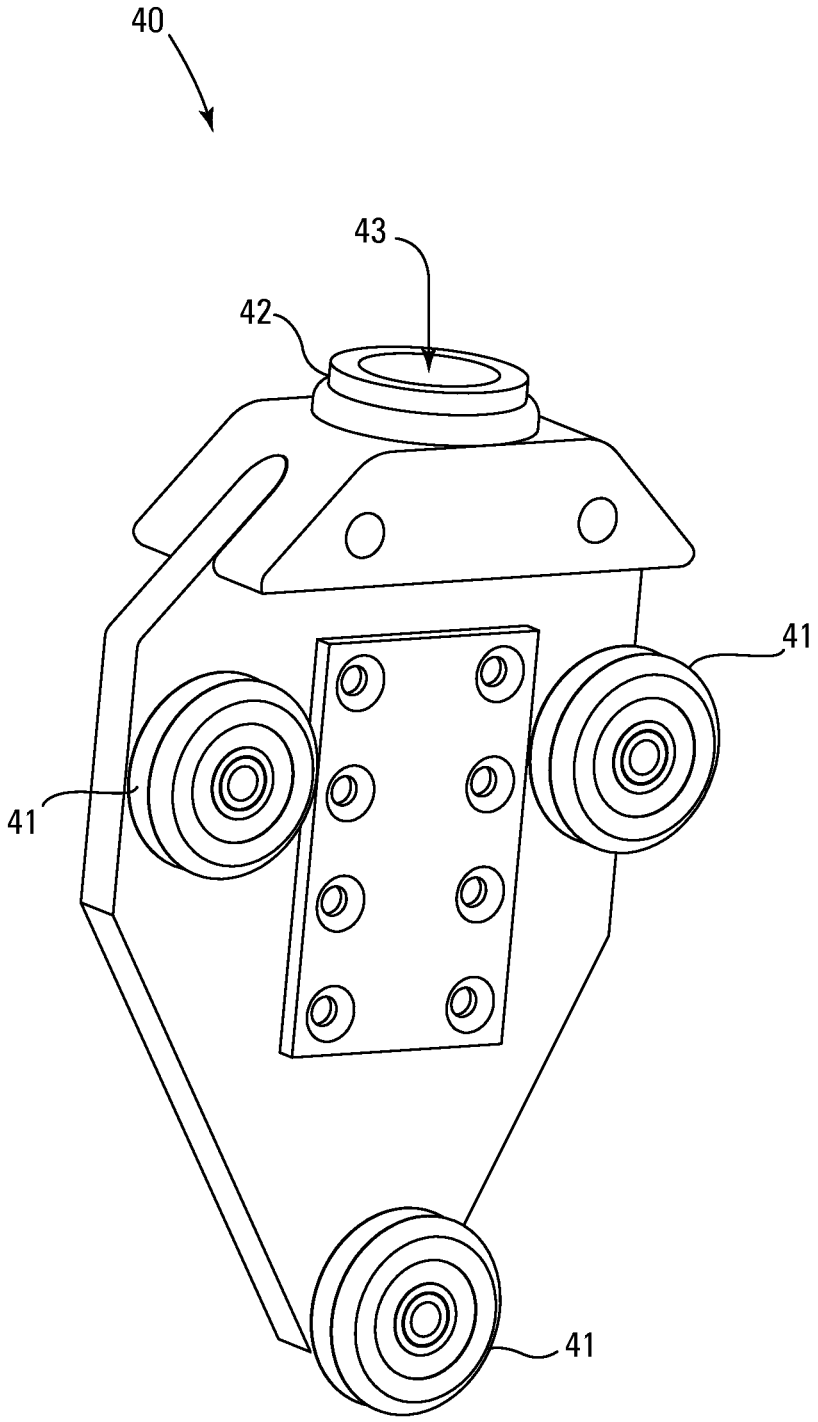
FIG. 10 is a side perspective view of the wheel side of the carriage in FIG. 5.

As shown in FIGS. 1 and 10, a shoulder 42 with a chamber 43 is positioned on top (not numbered) of the first carriage 40 to allow a first foot pedal 50 base member 53 to be inserted into the chamber 43 and support the foot pedal 50. Preferably the base member 53 pivotally attaches to the chamber 43 allowing rotation about a transverse axis Z1. As shown in FIG. 11, the first carriage 40 may have a shaft 44 and compression spring 45 within the chamber 43. The shaft 44 and spring 45 are configured and arranged such that as weight is applied to the first foot pedal 50 the base member 53 moves in the second transverse direction $Z_2$ and contacts the shaft 44 and spring 45 and compresses the spring 45. As weight is removed from the first foot pedal 50 the spring 45 elevates the shaft 44 and the base member 53 of the first foot pedal 50 in the first transverse direction $Z_1$ within the chamber 43. During the recovery phase (when a skater is bringing his feet together) he lifts his foot that is recovering while he brings his feet together to begin the next stride. The elevation of the base member 53 of the first foot pedal 50 in the first transverse direction $Z_1$ by the compression spring 45 within the chamber 43 during the recovery phase of the stride provides a more accurate "feel" or simulation allowing that recovering foot to rise without having to lift the entire weight of the first foot pedal 50.

The inside edge (not numbered) and or outside edge (not numbered) of the first carriage 40 may have an insulator or spacer (not shown) attached to protect the surfaces of the simulator 10 and decrease any metallic sound that may occur from the carriage 40 coming into contact with another metal surface. The insulator may be made from any suitable material such as rubber, plastic or other synthetic material.

As shown in FIG. 1, the simulator 10 may also have a second carriage 130 for reciprocating along the path 60 along the first rail 30. If the simulator 10 has a second rail, the second carriage 130 or a third and fourth carriage (not shown) may operably engage the second rail for reciprocating along the path along the second rail. The first carriage 40 and second carriage 130, when both are on the first rail 30, may be locked together. Locking the first carriage 40 and second carriage 130 together generates adjustable resistance during both the extension (abduction) phase of the lateral Y stride as well as the recovery (adduction) phase.

A socket 70 may also be provided for use with the simulator 10. The socket 70 is configured and arranged to receive the base member 53 of the first foot pedal 50 or second foot pedal 140 and support the foot pedal 50, 140 at the same height as the carriage 40, 130 would normally support the foot pedal 50, 140. The socket 70 may also be configured and arranged to allow pivotal attachment of the foot pedal 50, 140 to allow the foot pedal 50, 140 to pivot about a transverse axis Z1 just as the foot pedal 50, 140 can pivot on a carriage 40, 130.

The socket 70 may be configured and arranged to be portable with a wide base with a non-skid bottom to maintain stability and resist slipping or movement across the deck 21 of the simulator 10. Preferably the non-skid bottom is rubber. The socket 70 may then be placed anywhere on the deck 21 of the simulator 10.

The socket 70 may also be configured and arranged to attach directly to a shock assembly 110 or fixedly attached to the simulator 10.

As shown in FIG. 1, the skating simulator 10 also has a first foot pedal 50 attached to the first carriage 40. The first foot pedal 50 may be removably or fixedly attached to the first carriage 40. Preferably the first foot pedal 50 is removably attached to the first carriage 40. The first foot pedal 50 has an intermediate member 51, a foot pad 52, and a means for attaching the foot pad 52 to the intermediate member 51 allowing non circular arcuate movement of the foot pad 52 in relation to the intermediate member 51 in the longitudinal direction X and transverse direction Z. The non circular arcuate movement of the foot pad 52 is a rocking motion that allows the heel of the user to rise (in the first transverse direction) and move backward (in the second longitudinal direction) as the toes of the user move downward (in the second transverse direction) and backward (in the second longitudinal direction) and the heel then moves down and forward as the toes move up and forward. This non-circular arcuate movement allows the foot pad 52 to move in a toe to heel rocking motion on the first foot pedal 50 while allowing the user's foot to remain in a neutral, natural, comfortable, and appropriate position throughout the full range of motion.

Figure 7:
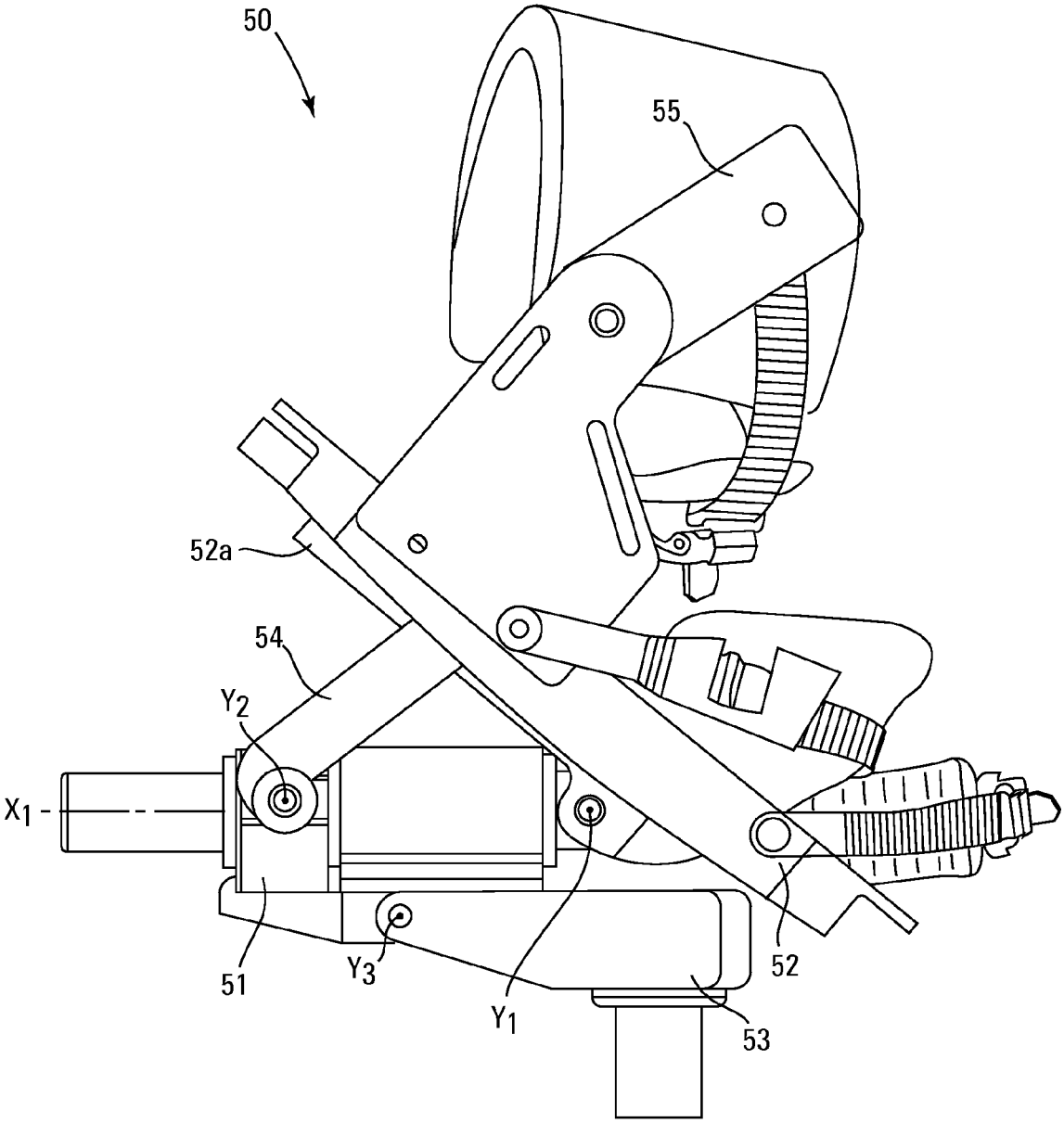
FIG. 7 is a side view of the foot pedal with full foot binder in FIG. 6 with the foot pad pivoted about the primary and secondary lateral axes.

As shown in FIG. 7, preferably the first foot pad 52 may also rotate about a longitudinal axis X1 in relation to the intermediate member 51 to allow the user's foot to not supinate or pronate during the extension and abduction of the leg. The entire first foot pedal 50 may also rotate about a transverse axis Z1 to provide additional movement of the user's foot to allow the user's foot to remain in a neutral, natural, comfortable, and appropriate position throughout the full range of motion.

As shown in FIG. 6-9, the foot pad 52 comprises a foot plate base **52*a* and a foot plate 52*b*. The foot plate 52*b* is configured and arranged to accept a user's foot or shoe. The top surface (not numbered) of the foot plate 52*b* is substantially flat to allow various shaped shoes or feet to rest on the top surface of the foot plate 52*b*. As shown in FIG. 7, the foot plate 52*b* preferably has a foot binder 55 attached to secure the user's shoe and or foot to the foot pad 52. The preferred foot binder 55 has hinged and adjustable heel, shin, arch, and toe straps. Attaching the top of the hinged upper foot binder 55 to the opposite upper binding with a padded strap around the back of lower leg (calf) posterior permits both upper hinged portions of the bindings to flex and extend simultaneously with the ankle while offering lateral support to the ankle. As a result, the foot binder 55 will resist any movement by the user's foot to supinate or pronate. Preferably the foot binder 55** is made from stiff plastic.

Figure 9:
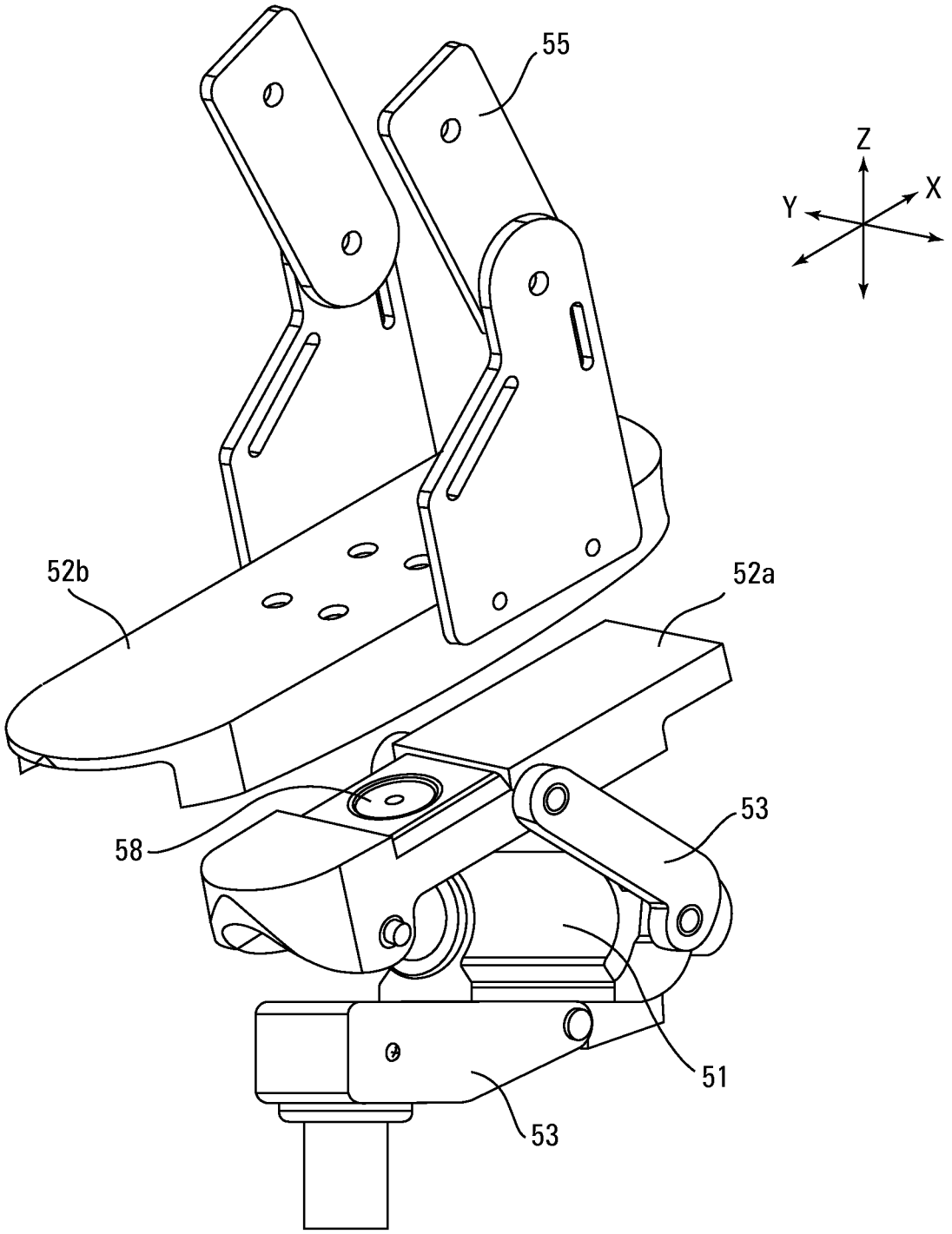
FIG. 9 is a side perspective view of the foot pedal in FIG. 7 with the foot plate detached from the foot plate base.

The foot plate 52*b* may be fixedly attached to the foot plate base 52*a* or removeably attached. As shown in FIG. 9, preferably the foot plate 52*b* is magnetically attached to the foot plate base 52*a*. The magnetic attachment 58 of the foot plate 52*b* to the foot plate base 52*a* is configured and arranged to allow the foot plate 52*b* to separate from the foot plate base 52*a* when other than normal forces for reciprocating the first carriage 40 along the path 60 of the first rail 30 are applied to the foot plate 52*b* to help prevent injury to the simulator 10 user.

Figure 8:
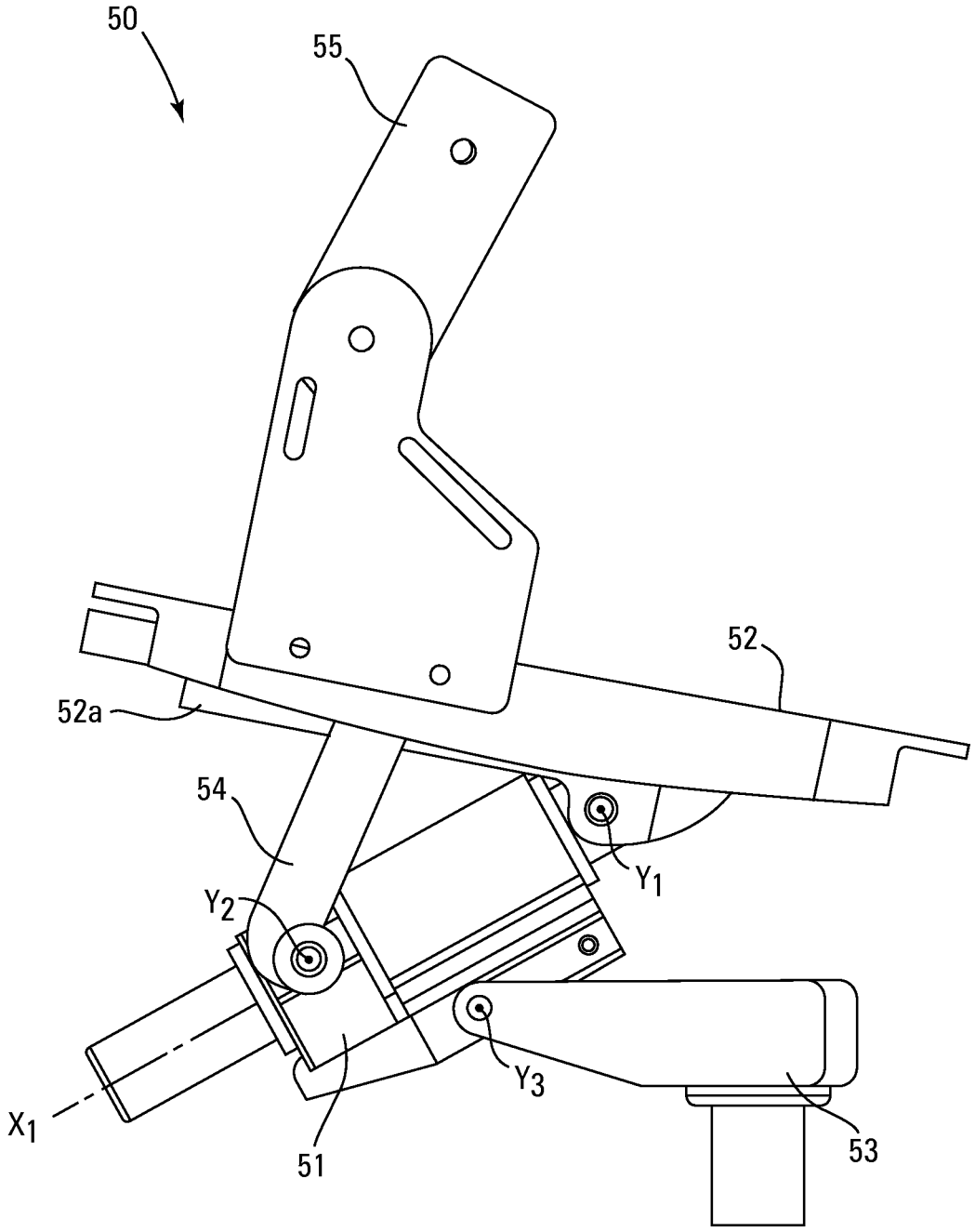
FIG. 8 is a side view of the foot pedal in FIG. 7 with the foot pad pivoted in about the third lateral axis.

As shown in FIGS. 7-9, a first embodiment of the foot pedal 50 pivotally attaches the foot plate base 52*a* of the foot pad 52 to an intermediate member 51 for pivoting about a primary lateral axis Y1 and reciprocating in the longitudinal direction X relative to a secondary lateral axis Y2. Preferably the pivot connection (not numbered) is proximate the toe end 56 of the first foot pedal 50. Most preferably the pivot connection is proximate the placement of the ball of the foot on the first foot pedal 50. As shown in FIG. 7, the preferred intermediate member 51 is a piston to allow reciprocating in the longitudinal direction X and rotation about a longitudinal axis X1. A restriction link 54 is pivotally attached to the foot pad 52 proximate the heel end 57 of the foot pad 52 and the intermediate member 51 for pivoting about the secondary lateral axis Y2.

As shown in FIG. 7, the intermediate member 51 is attached to a base member 53. Preferably the intermediate member 51 is pivotally attached to the base member 53 to allow the entire first foot pedal 50 to pivot about a third lateral axis Y3. The base member 53 attaches to the first carriage 40. Preferably the base member 53 pivotally attaches to the first carriage 40 to allow pivoting of the base member 53 and first foot pedal 50 about a transverse axis Z1. The base member 53 may be fixedly attached or removably attached to the first carriage 40. The base member 53 is most preferably removably attached to the first carriage 40.

The first foot pedal 50 may also be configured and arranged with locks (not shown) to prohibit movement of the first foot pedal 50 about a particular axis. Having limited movement about a particular axis provides the users with varying options of exercise with varying degrees of ankle flexibility.

Figure 17:
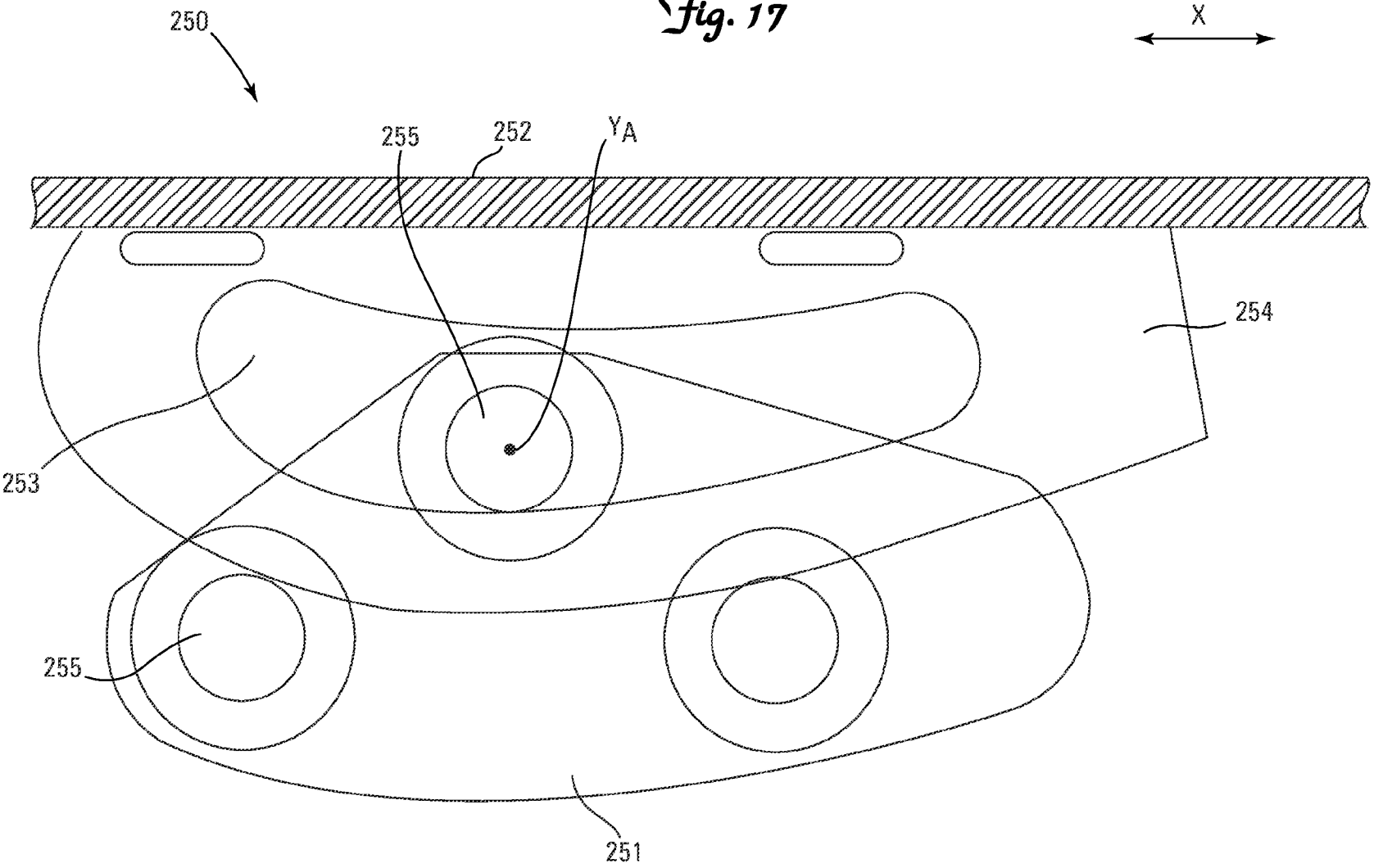
FIG. 17 is a partial side view of a second embodiment of the foot pedal.

As shown in FIG. 17, a second embodiment of the foot pedal 250 has a foot pad 252 attached to a longitudinally extending cam 254. The intermediate member 251 is attached to at least one cam roller 255. The cam roller 255 reciprocates in the longitudinal direction X and transverse direction Z along the cam 254. Preferably the cam 254 has a longitudinally extending non-circular arcuate opening 253 through the center (not numbered) of the cam 254. The intermediate member 251 may have a cam roller 255 reciprocating in the longitudinal direction X and transverse direction Z along the non-circular arcuate opening 253 through the center of the cam 254 and one or more additional cam rollers 255 reciprocating in the longitudinal direction X and transverse direction Z along the outer edge (not numbered) of the cam 254.

Figure 18:
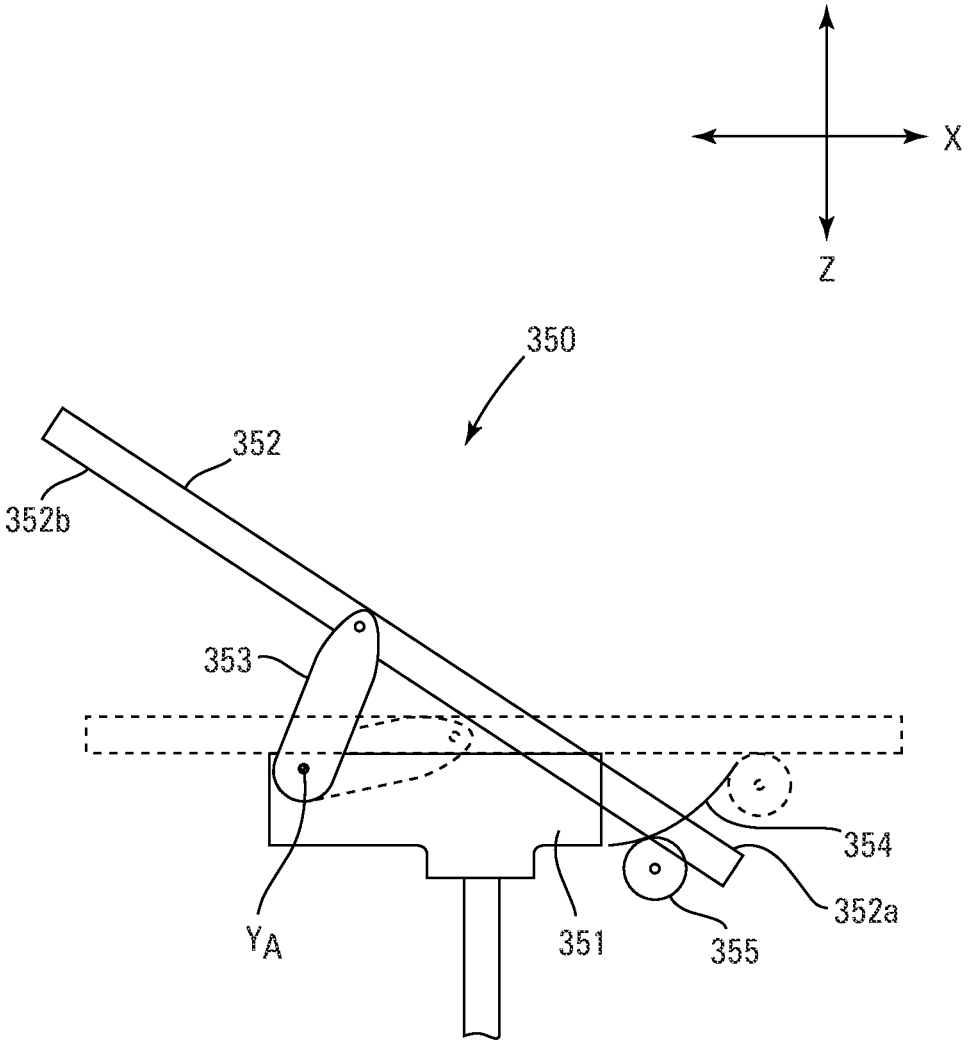
FIG. 18 is a partial side view of a third embodiment of the foot pedal.

As shown in FIG. 18, a third embodiment of the foot pedal 350 has a foot pad 352 pivotally attached to a cam roller 355 proximate the toe end 352*a* of the foot pad 352. A cam 354 is attached to the intermediate member 351. The cam roller 355 reciprocates along an outside edge (not numbered) of a cam 354 in a longitudinal direction X and transverse direction Z. A restriction link 353 is pivotally attached to the foot pad 352 proximate the heel end 352*b* of the foot pad 352 and pivotally attached to the intermediate member 351 for pivoting about a lateral axis $Y_A$.

As shown in FIG. 19, a fourth embodiment of the foot pedal 450 has a foot pad 452 pivotally attached to the intermediate member 451 by a first link 453 for pivoting about a primary lateral axis Y1 and reciprocating in the longitudinal direction X relative to a secondary lateral axis Y2 and by a second link 454 for pivoting about the second lateral axis Y2. The second lateral axis Y2 is longitudinally X spaced from the first lateral axis Y1. The preferred arrangement of the links 453, 454 is a planar four bar linkage in a double rocker configuration. In such a configuration the foot pad 452 is the coupler link, the intermediate member 451 is the ground link, and the first and second links 453, 454 are the grounded links.

As shown in FIG. 1, the simulator 10 may also have a second foot pedal 140. The second foot pedal 140 may be used with the first carriage 40, the second carriage 130 or the socket 70. The second foot pedal 140 is preferably identical to the first foot pedal 50.

Figure 15:
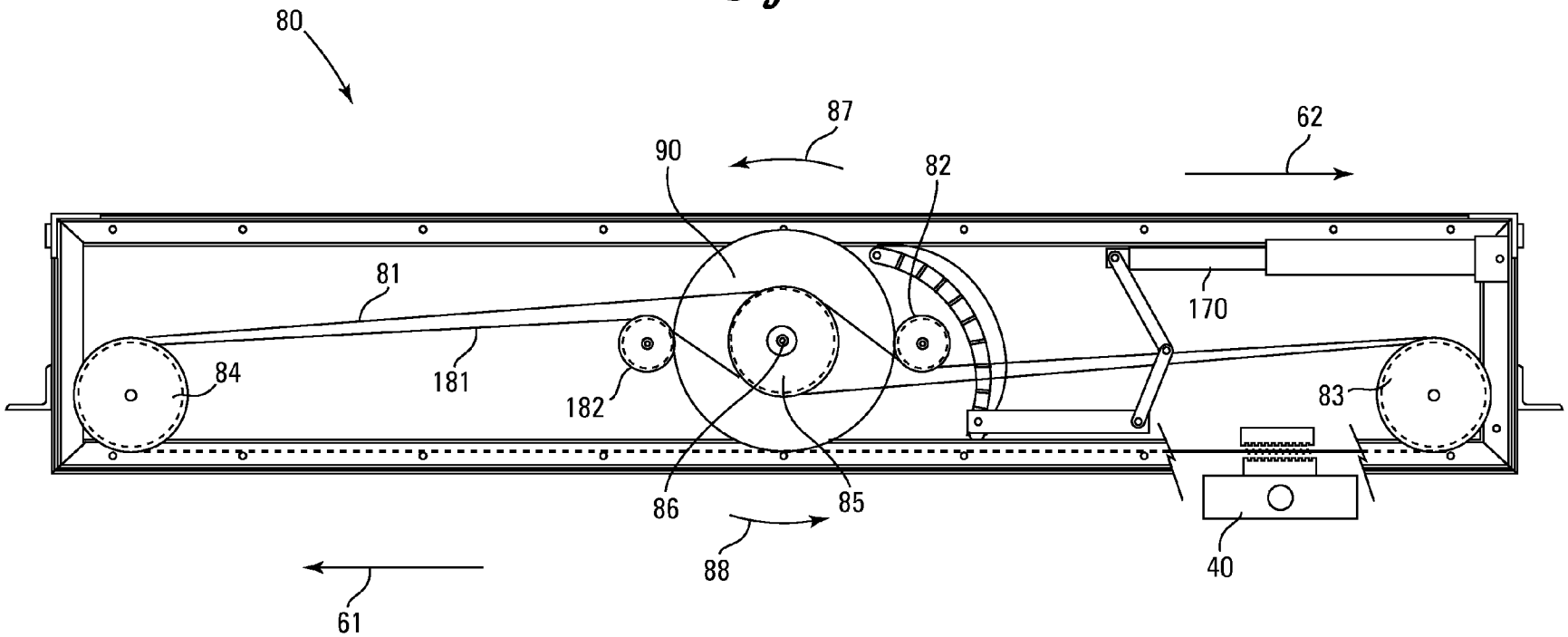
FIG. 15 is a top view of one embodiment of the main frame assembly and momentum storage device in the simulator in FIG. 1.

As shown in FIG. 15 a main frame assembly 80 is linked to the first carriage 40 and engages a momentum storage device 90 when the first carriage 40 reciprocates along the first rail 30 in a first direction 61 along the path 60 but not a second direction 62 along the path 60. If the skating simulator 10 has a second carriage 130 it is also linked to the main frame assembly 80 and engages the momentum storage device 90 when the second carriage 130 reciprocates along the first rail 30 along the path 60 in the second direction 62 but not the first direction 61 along the path 60.

Momentum storage devices 90 are well known in the industry. Any suitable momentum storage device 90 may be used. The preferred momentum storage device 90 is a flywheel.

Figure 16:
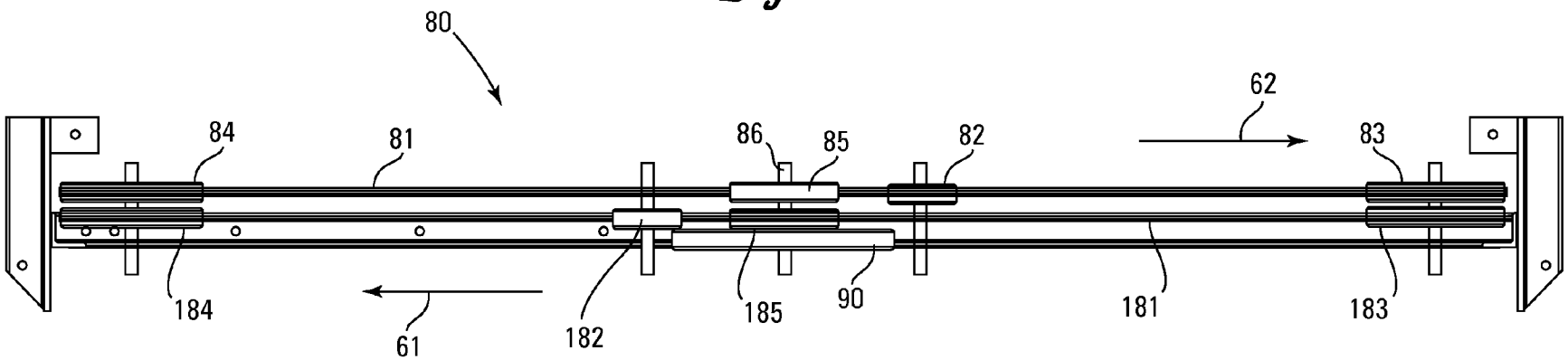
FIG. 16 is a side view of the main frame assembly and momentum storage device in FIG. 15.

A preferred embodiment of the main frame assembly 80 is shown in FIGS. 15 and 16. The main frame assembly 80 has a first belt 81, a first tension pulley 82, first corner pulley 83, second corner pulley 84, a first drive pulley 85 with a one-way clutch, and a drive shaft 86. The first drive pulley 85 and the momentum storage device 90 are rotatably attached to the drive shaft 86. The first belt 81 engages the first drive pulley 85, the first corner pulley 83, the second corner pulley 84, and the first tension pulley 82. The first tension pulley 82 is biased to tension the first belt 81 to remain in contact with the pulleys 82, 83, 84, and 85 during use.

As shown in FIG. 15, the first belt 81 engages the first drive pulley 85. The first belt 81 is attached to the first carriage 40. As the user extends/abducts his hips (to push off) and adducts his hips (brings his feet together) the first carriage 40 reciprocates in a first direction 61 and a second direction 62 along the path 60 of the first rail 30. As the first carriage 40 is attached to the first belt 81, the first belt 81 also reciprocates a first direction 61 and second direction 62. As the user extends/abducts his hips (to push off) the first carriage 40 and the first belt 81 move in the first direction 61. As the first belt moves in the first direction 61, the first drive pulley 85 rotates in a first direction 87. As the user adducts his hips (brings his feet together) the first belt 81 moves in the second direction 62 and the first drive pulley 85 rotates in a second direction 88. The first drive pulley 85 has a one way clutch (not shown) inserted in its bore (not shown). The one-way clutch allows the first drive pulley 85 to engage the drive shaft 86 when rotating in the first direction 87 and free wheel when rotating in the second direction 88. The preferred clutches are a Sprague clutch or a roller bearing clutch. When the first drive pulley 85 rotates in the first direction 87 it engages the momentum storage device 90.

The main frame assembly 80 may also have a second belt 181, a second tension pulley 182, third corner pulley 183, fourth corner pulley 184 and a second drive pulley 185 with a one-way clutch. The first and third corner pulleys 83 and 84 may use a common shaft (not numbered) and the second and fourth corner pulleys 183 and 184 may share a common shaft (not numbered). The second drive pulley 185 is rotatably attached to the drive shaft 86. The second belt 181 engages the second drive pulley 185, the third corner pulley 183, the fourth corner pulley 184, and the second tension pulley 182. The second tension pulley 182 is biased to tension the second belt 181 to remain in contact with the pulleys 182, 183, 184, and 185 during use.

As shown in FIGS. 15 and 16, the second belt 181 engages the second drive pulley 185. The second belt 181 contacts the second drive pulley 185 in a diametrically opposed position to the first belt 81 contacting the first drive pulley 85. The second belt 181 is attached to the second carriage 130. As the user extends/abducts his hips (to push off) and adducts his hips (brings his feet together) the second carriage 130 reciprocates in the first direction 61 and the second direction 62 along the path 60 of the first rail 30. As the second belt 181 is attached to the second carriage 130, the second belt 181 also reciprocates the first direction 61 and second direction 62. As the user extends/abducts his hips (to push off) the second carriage 130 and the second belt 181 move in the second direction 62. As the second belt 181 moves in the second direction 62, the second drive pulley 185 rotates in the second direction 88. As the user adducts his hips (brings his feet together) the second belt 181 moves in the first direction 61 and the second drive pulley 185 rotates in the first direction 87. The second drive pulley 185 has a one way clutch (not shown) inserted in its bore (not shown). The one-way clutch allows the second drive pulley 185 to engage the drive shaft 86 when rotating in the second direction 88 and free wheel when rotating in the first direction 87. The preferred clutches are a Sprague clutch or a roller bearing clutch. When the second drive pulley 185 rotates in the second direction 88 it engages the momentum storage device 90.

The main frame assembly 80 may also have a variable resistance means 170 allowing the user to set a desired level of resistance to the first drive pulley 85 or second drive pulley 185 when they engage the momentum storage device 90. Any variable resistance means 170 may be used such as friction, belts, electromagnetic means, magnetic means or other techniques well known in the art. The preferred variable resistance means 170 is an Eddy current clutch with a linear actuator. Preferably the variable resistance means 170 is controllable through the control panel 150 to allow the user to vary the resistance of the first drive pulley 85 and the second drive pulley 185 while using the simulator 10.

Figure 4:
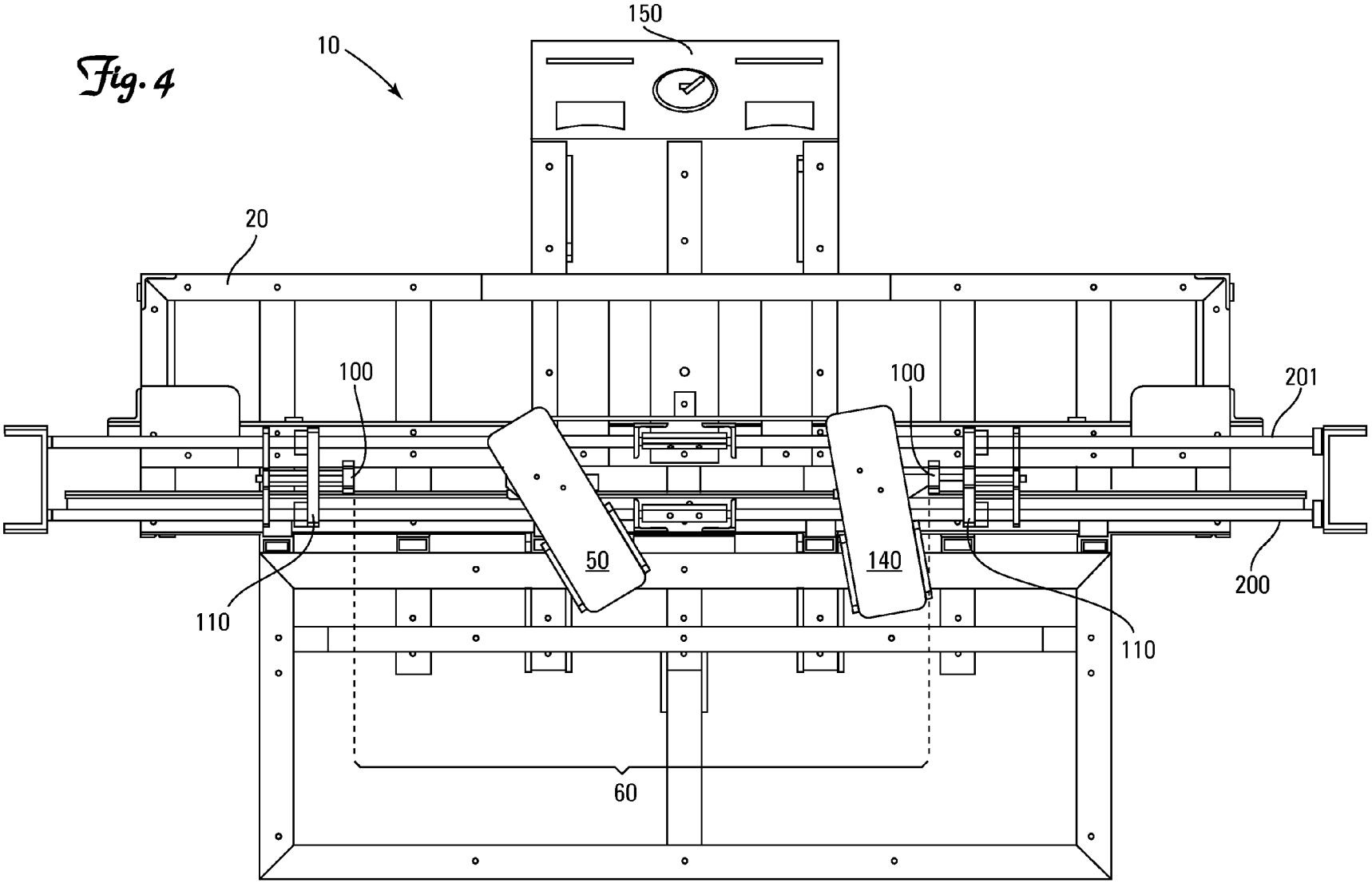
FIG. 4 is a top view of the simulator in FIG. 3.

As shown in FIGS. 3 and 4, preferably the first carriage 40 and second carriage 130 reciprocate along the first rail 30 between two stops 100 to keep the carriages 40, 130 from sliding off either end (not numbered) of the first rail 30. Most preferably the stop 100 at each end of the first rail 30 is attached to a shock assembly 110. The shock assemblies 110 absorb the momentum of the user reciprocating across the first rail 30 at some predetermined distance. The shock assemblies 110 work in conjunction with each other to absorb the momentum of the first carriage 40 and second carriage 130 with an increasing rate of resistance until the first and second carriages 40, 130 have come to a complete stop. The shock assemblies 110 work together to gradually reduce the user's speed in an effort to minimize or eliminate any hard or sudden stops. Shock assemblies 110 are well known in the relevant field.

Figure 12:
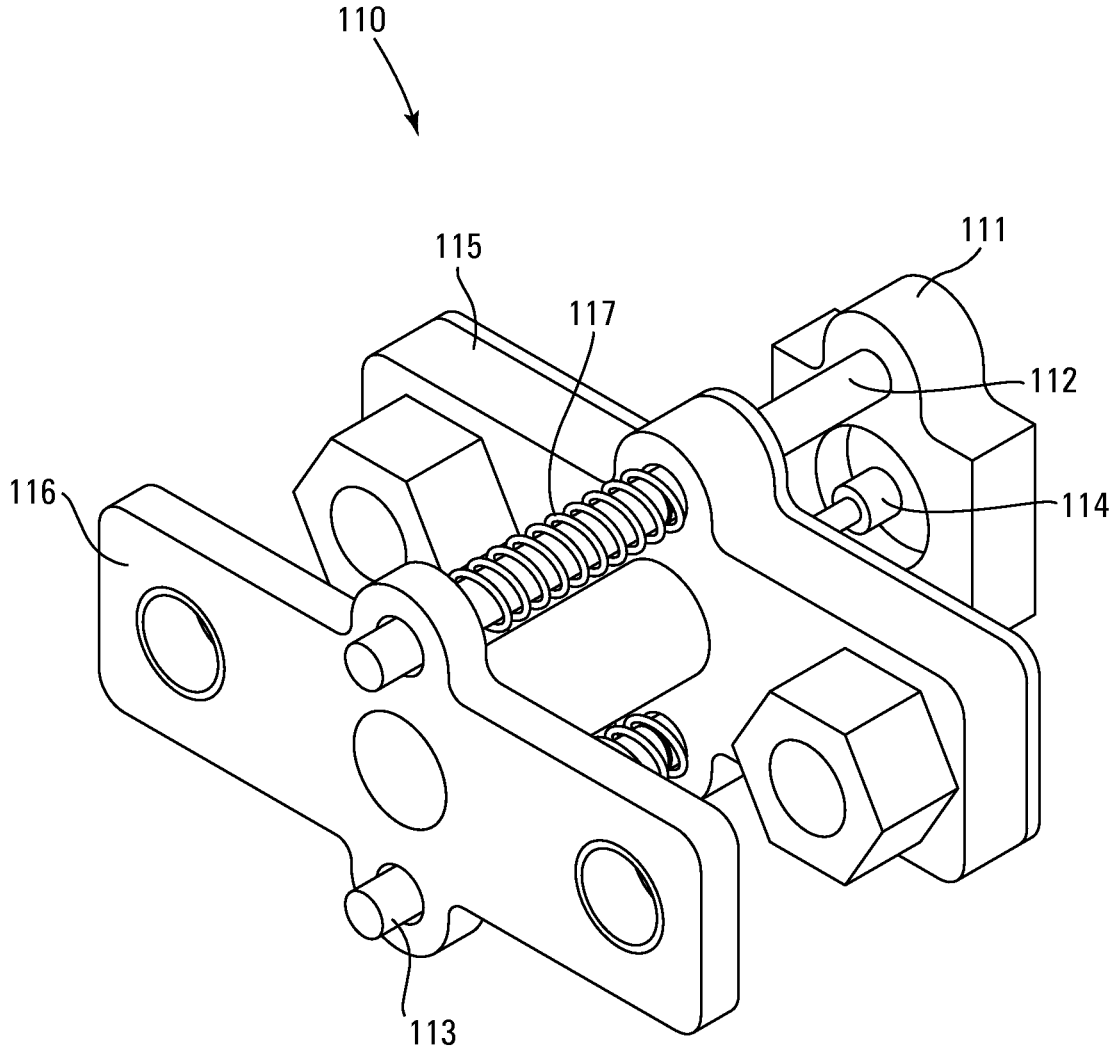
FIG. 12 is a front perspective view of one embodiment of the stop and shock assembly in FIG. 3.

As shown in FIGS. 3, 4, and 12 a first preferred shock assembly 110 has a bumper 111 attached to a first push rod 112, a second push rod 113, and a shock absorber 114. The push rods 112, 113 slidably attach to a face plate 115 and fixedly attach to a stabilizer plate 116. A compression spring 117 is wrapped about each push rod 112, 113 between the face plate 115 and the stabilizer plate 116. As a force is applied to the bumper 111, the bumper 111 compresses the shock absorber 114 and the compression springs 117 to soften the deceleration of the foot pedal 50, 140 and carriage 40, 130.

Figure 13:
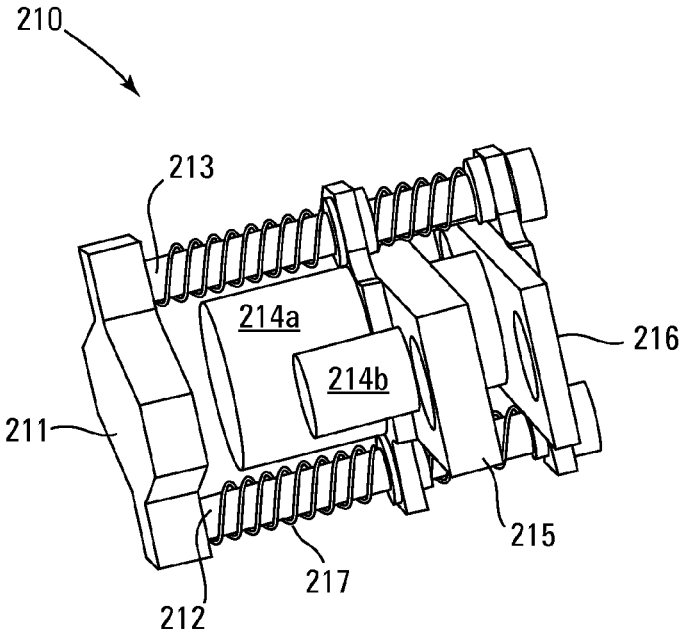
FIG. 13 is a side perspective view of a second embodiment of a stop and shock assembly.
Figure 14:
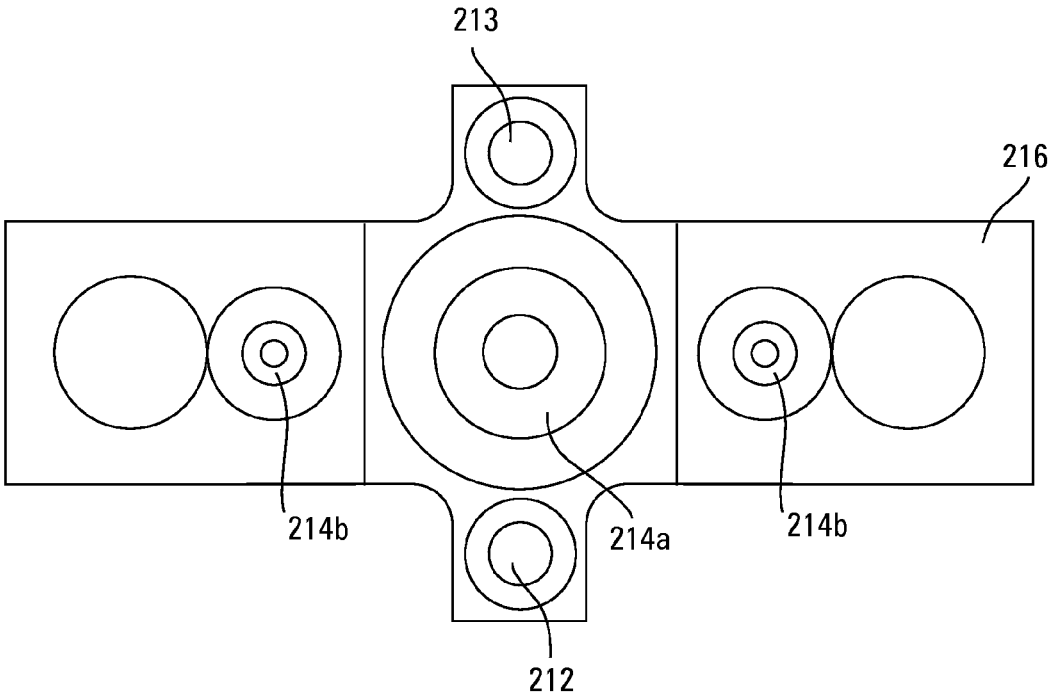
FIG. 14 is a back view of the stop and shock assembly in FIG. 13.

As shown in FIGS. 13 and 14, a second embodiment of the shock assembly 210 has a bumper 211, attached to a first push rod 212, a second push rod 213, a primary compression cylinder of 214*a* and two secondary compression cylinders 214*b*. The primary compression cylinder 214*a* is a larger diameter and different compression ability than the secondary smaller diameter cylinders 214*b*. The primary and secondary cylinders 214*a* and 214*b* may be made from any suitably compressible material such as rubber, plastic, or cork. Preferably the primary and secondary cylinders 214*a* and 214*b* are made of rubber. The push rods 212, 213 slidably attach to a face plate 215 and fixedly attach to a stabilizer plate 216. A compression spring 217 is wrapped about each push rod 212, 213 between the bumper 211 and the face plate 215. As a force is applied to the bumper 211, the bumper 211 pushes the push rods 212, 213 and compresses the springs 117 until the bumper 211 comes into contact with the primary cylinder 214*a*. The primary cylinder 214*a* is compressed until the bumper 211 comes into contact with the secondary cylinders 214*b* to soften the deceleration of the foot pedal 50, 140 and carriage 40, 130.

The shock assemblies 110 may be placed proximate each end of the first rail 30 to allow the first carriage 40 to travel from one end of the first rail 30 to the other end. Most preferably the shock assemblies 110 are repositionable along the first rail 30 to allow the user to govern the distance between the shock assemblies 110 on the first rail 30. This in turn will control the distance the user reciprocates along the first rail 30 and also determine the length of the user's stride (skating stride). Any suitably mechanism may be used to adjust the position of the shock assemblies 110 along the first rail 30 such as a rack and pinion, cable around a barrel, chain drive, a hydraulic system, or a pneumatic system. The most preferred mechanism is a lead screw assembly.

As shown in FIGS. 3 and 4, preferably the lead screw assembly 200 has 4 lead screws 201 (or two long ones with opposite threads at each end) with the first carriage 40 traveling between the lead screws 201 and contacting the shock assembly 110 between the lead screws 201 so the force of any impact is distributed between two lead screws 210 rather than one. The 4 lead screws 210 with both left and right hand threads, a series of sprockets (not numbered) and chains (not numbered) and bearings (not numbered) move the shock assemblies 110 back and forth along the path 60 along the first rail 30.

It is the lead screw assembly 200 that support the shock assemblies 110 throughout their movement and when they are absorbing the forces or momentum of the individual using the skating simulator 10. When the first carriage 40 reciprocates along the first rail 30 the first carriage 40 will continue sliding along the first rail 30 until it makes contact with a shock assembly 110. The shock assembly 110 will absorb the energy and transmit these forces into the lead screw assembly 200. Once these deceleration forces have been distributed throughout the lead screw assembly 200 the forces are transmitted for dissipation to various other parts of the skating simulator 10. The lead screws assembly 200 will be driven by a motor (not shown) mounted inside the skating simulator 10. This power will be transmitted to the drive side of the lead screw assembly 200 with a chain and a series of sprockets and jack shafts.

The motor will be controlled by a three way rocker switch (not shown) located on the control panel 150. By pressing this rocker switch to one side the motor will turn and transmit the power necessary to rotate the lead screws 201 which by turning will increase the distance between the shock assemblies 110. When the other side of the rocker switch is depressed the motor will run in the reverse direction thereby turning the lead screws in the opposite direction and decreasing the distance between the shock assemblies 110. The three way rocker allows the user to adjust the reciprocating or sliding length while using the skating simulator 10.

Preferably cut out switches (not shown) electronically cut out the motor when the shock assemblies 110 have reached their maximum or minimum distance and automatically reset when the engine is reversed.

As shown in FIGS. 1 and 2, the skating simulator 10 may also have a bench 120 attached to the deck 21 of the frame 20. The bench 120 is mounted to the frame 10 in the rear of the simulator 10 and is preferably parallel to the first rail 30. The bench 120 allows the user to sit while adjusting the foot pedals 50, 140 and preparing to use the simulator 10. It also provides a place to sit if the user tires or loses his balance while using the simulator 10. The bench 120 may also serves as a base for a belt rail (not shown). Preferably, the bench 120 is adjustable both horizontally and vertically relative to the deck 21 of the frame 20 to better accommodate the user as it relates to training, safety, providing support, and clearance. An adjustable bench 120 allows the user to place the bench 120 where it will not interfere with use of the simulator 10 or to place the bench 120 so that is may assist in use of the simulator 10. The bench 120 may be manually or electronically adjustable.

The bench 120 may also have a belt rail (not shown). The belt rail may be an integral part of the bench 120 or removably attached to the bench 120. As it is either an integral part of the bench 120 or attached to the bench 120, the belt rail is fully adjustable both horizontally and vertically, to the extent the bench 120 is adjustable, so it can be positioned exactly where it would be of greatest benefit to the individual using the skating simulator 10. Although the vertical location and the proximity of the belt rail to the front or rear of the simulator 10 will be left to the discretion of the user in adjusting the position of the bench 120, the belt rail remains parallel to the first rail 30. A belt (not shown) worn around the individual's waist attaches to a carriage (not shown) attached to the belt rail which reciprocates along the length of the belt rail in unison with the individual as he reciprocating back and forth along the first rail 30. Use of the belt and belt rail may be used to restrict the individual's ability to stand upright while exercising on the simulator 10. The location of the belt rail and bench 120 predetermines the minimum amount of knee bend the individual may use while reciprocating along the first rail 30. The lower the belt rail the deeper the knee bend that will be required. Deeper knee bend in the gliding leg is generally associated with longer more powerful strides and is considered better skating technique. By adjusting the bench 120 and belt rail vertically and or horizontally as well as adjusting the strap and or belt the simulator 10 can be used to modify the user's technique.

As shown in FIG. 1, the simulator 10 has a control panel 150 and hand support 160 attached to the frame 20. Preferably the control panel 150 is located in the front and center of the frame 20 on the opposite side of the first rail 30 as the bench 120. This placement of the control panel 150 the control panel 150 to be easier to read and access while using the simulator 10. Placement of the control panel 150 in the center of the length of the frame 20 allows greater structural integrity for a hand support 160.

The control panel 150 is preferably within easy reach of the individual using the simulator 10. The control panel 150 may have instruments which provide feedback to the user and various switches which control mechanical features found on the simulator 10.

Preferably the control panel 150 provides a wide variety of feed back, such as, average speed, degree of ankle bend, degree of knee bend, the distance between the feet when weight transfer occurs, the rate at which energy (or watts) are being expended, total number of watts burned (or energy spent) during the course of use, calories burned, stride length, and stride tempo. The control panel 150 may also allow the user to adjust the position of the stops 100 and shock absorbers to adjust his stride. The user may also adjust the tension resistance using the variable resistance means 170 in the main frame assembly 80.

Preferably, the hand support 160 as shown in FIG. 1, allows an individual's hands to rest on the hand support 160 all the way from one side of the simulator 10 to the other. The hand support 160 not only offers the user support and assistance with balance but may be used with a wide variety of training aids and instruments.

Use

An exemplary use of the simulator 10 involves an individual stepping onto the simulator 10. A foot is inserted into the first foot pedal 50 and a foot is inserted into the second foot pedal 140. The foot binders 55 are tightened to secure the first foot pedal 50 to one foot and the second foot pedal 140 to the other foot. The simulator 10 is then turned on. The stops 100 may be adjusted to best accommodate the user's height, stride length, and/or training objectives. The stops 100 can be readjusted during use of the simulator 10 without interrupting use of the simulator 10. The variable resistance means 170 may also be adjusted to accommodate varying training objectives. The user may move the foot pedals 50, 140 to one end of the first rail 30 with the first foot pedal 50 next to a stop 100 and the second foot pedal 140 next to the first foot pedal 50. The user may now bend at the knees while maintaining an upright position in the upper body and begin to move the second foot pedal 140 away from the first foot pedal 50 by pushing the first foot pedal 50 against the stop 100.

This will be accomplished by contracting the gluteal muscle group and sartorius on both hips simultaneously, thereby working them against each other to abduct both thighs which will initiate sideways movement of one's body and forcing the first foot pedal 50 across the longitudinally extending first rail 30 along the path 60. As the thighs abduct, the quadriceps and calf muscles on the first foot pedal 50 (pushing foot), will simultaneously contract, generating the forces necessary to extend the knee and ankle. The forces generated by these muscle groups abducting the hip and extending the knee and ankle will combine to propel the individual across the longitudinally extending rail 30. The second foot pedal 140 will travel along the longitudinally extending rail 30 until it comes into contact with the second stop 100. Upon contact with the second stop 100 the second foot pedal 140 will stop traveling along the rail 30 and the first foot pedal 50 will continue along the first rail 30 until the first foot pedal's 50 movement is stopped by coming into contact with the second foot pedal 140. The user then repeats the movements but in the opposite direction. The user continues with this motion of travel along the first rail 30 leading with one foot and following with the other until both feet come together once again at the opposite end of the machine. As the leading foot travels along the first rail 30 the respective carriage 40, 130 linked to the main frame assembly 80 engages the momentum storage device 90 and provides resistance to the leading foot pedal 50, 140. As the pushing foot pedal 50, 140 travels along the first rail 30 after the leading foot pedal 50, 140, the corresponding carriage 40, 130 does not engage the momentum storage device 90 and no resistance is provided to the pushing foot pedal 50, 140 as it travels along the first rail 30.

While traveling along the first rail 30 the foot pedals 50, 140 pivot about the longitudinal axis, transverse axis, and lateral axis relative to the carriage 40, 130 of each foot pedal 50, 140 allowing the user's feet, ankles, and knees to remain in a neutral, natural, comfortable, and appropriate position throughout the entire range of motion.

Both the length of the stride (by repositioning the first and second stops 100 along the path 60) and the level of resistance (by adjusting the force required to move the carriages 40, 130 along the first rail 30) can be adjusted infinitely by the individual using the simulator 10 while he is using the simulator 10 by simply reaching out and engaging the appropriate switch (not numbered) on the control panel 150. This will not only provide ease and convenience for adjusting the simulator 10, but will at the same time offer the individual the ability to design and incorporate a much broader range of training options and techniques than previously imaginable.

The simulator 10 may also be used with the fixed position socket 70. If the socket 70 is a portable socket 70 it may be placed anywhere on the deck 21 of the simulator 10 in a location to allow the user to isolate and work specific muscle groups. Once the socket 70 is placed on the deck 21 in the desired location, the base member 53 of the first foot pedal 50 is inserted in to the socket 70. The second foot pedal 140 is then placed in either its normal carriage 130 or in the opposite carriage 40. If the second foot pedal 140 is removed from its usual carriage 130 and attached to the opposite carriage 40, this has the effect of reversing the resistance from overloading the muscles associated with the extension phase of the skating stride to instead overloading those muscles associated with the recovery phase of the skating stride. This allows the user to create different levels of resistance on those muscles in the groin region responsible for bringing the feet together at the end of each skating stride.

Once the foot pedals 50, 140 are in place the user will then bend his knees and extend his foot in the second foot pedal 140 along the first rail 30 before bringing it back to its original starting point. The momentum storage device 90 will be engaged when the foot pedals 50, 140 are coming together (thus working the groin muscles) as opposed to when they are spreading apart.

The user may also link the first and second carriages 40, 130 together. If the two carriages 40, 130 are linked together then the momentum storage device 90 will be engaged as the second foot pedal 140 reciprocates in the first direction 61 and the second directions 62 along the first rail 30. If the momentum storage device 90 is engaged as the foot pedal reciprocates in both the first direction 61 and second direction 62 along the first rail 30, the user will be subjected to the same level of resistance during the extension phase and the recovery phase of the stride.

The user can also change the dynamics of the exercise by rotating the foot pedals 50, 140 about the transverse axis relative to the carriage 40, 130 or fixed socket 70. The position of the body can be incrementally rotated to a fraction of a degree which in turn will determine very incrementally which muscles of groin region will be involved and to what degree and in what fashion. This rotation may give the athlete unlimited flexibility in isolating the groin muscles to be rehabilitated or conditioned.

I claim:

1. A skating simulator comprising:

(a) a frame;

(b) a longitudinally extending rail fixedly attached to the frame;

(c) a carriage operably engaging the rail for reciprocating along a path along the rail; and (d) a foot pedal attached to the carriage having, (i) an intermediate member, (ii) a foot pad, and (iii) means for attaching the foot pad to the intermediate member allowing non circular arcuate movement of the foot pad in relation to the intermediate member in the longitudinal and transverse directions.

2. The skating simulator as recited in claim 1 wherein the foot pad is pivotally attached to the intermediate member for pivoting about a primary lateral axis and reciprocating in the longitudinal direction relative to a secondary lateral axis, and having a restriction link pivotally attached to the foot pad and pivotally attached to the intermediate member for pivoting about the secondary lateral axis.

3. The skating simulator as recited in claim 1 wherein (i) the foot pad is attached to a longitudinally extending cam, (ii) the intermediate member is attached to at least one cam roller, and (iii) the cam roller reciprocates in the longitudinal direction and transverse directions along the cam.

4. The skating simulator as recited in claim 1 wherein (i) the foot pad is pivotally attached to a cam roller and a cam is attached to the intermediate member, (ii) the cam roller reciprocates along the cam in a longitudinal and transverse direction, and (iii) a restriction link is pivotally attached to the foot pad and pivotally attached to the intermediate member for pivoting about a lateral axis.

5. The skating simulator as recited in claim 1 wherein (i) the foot pad is pivotally attached to the intermediate member by a first link for pivoting about a first lateral axis and the foot pad is pivotally attached to the intermediate member by a second link for pivoting about a second lateral axis and (ii) the second lateral axis is longitudinally spaced from the first lateral axis.

6. The skating simulator as recited in claim 1, further comprising (e) a second carriage operably engaging the rail for reciprocating along the path along the rail; and (f) a second foot pedal attached to the second carriage.

7. The skating simulator as recited in claim 6, further comprising a main frame assembly linked to the carriage and the second carriage wherein the main frame assembly engages a momentum storage device when (1) the carriage reciprocates along the rail in a first direction along the path but not a second direction along the path and (2) the second carriage reciprocates along the rail along the path in the second direction but not the first direction along the path.

8. The skating simulator as recited in claim 1, further comprising a main frame assembly linked to the carriage wherein the main frame assembly engages a momentum storage device when the carriage reciprocates along the rail in a first direction along the path but not a second direction along the path.

9. The skating simulator as recited in claim 1, further comprising a fixed position socket removeably attached to the frame and configured and arranged for removeable attachment of the foot pedal.

10. The skating simulator as recited in claim 1, further comprising a stop attached to the rail wherein the stop is (1) configured and arranged to stop movement of the carriage along the path and (2) repositionable relative to the path.

11. The skating simulator as recited in claim 10, further comprising a shock absorber attached to the stop.

12. The skating simulator as recited in claim 10, wherein the stop is repositionable relative to the path and extemporaneously adjustable without interrupting use of the simulator.

13. The skating simulator as recited in claim 1, wherein (1) the foot pad further comprises at least a foot binder and a foot plate base and (2) the foot binder is removeably attached to the foot plate base.

14. The skating simulator as recited in claim 1, wherein the foot pedal is pivotally attached to the carriage for pivoting about a transverse axis.

15. The skating simulator as recited in claim 1, wherein the foot pad pivots about a longitudinal axis.

16. A skating simulator foot pedal comprising:

(a) an intermediate member;

(b) a foot pad; and (c) means for attaching the foot pad to the intermediate member allowing non circular arcuate movement of the foot pad in relation to the intermediate member in the longitudinal and transverse directions.

17. The foot pedal as recited in claim 16, further comprising a base member pivotally attached to the intermediate member for pivoting about a lateral axis.

18. The foot pedal as recited in claim 16, wherein the foot pad pivots about a longitudinal axis.

19. The foot pedal as recited in claim 16 wherein the foot pad is pivotally attached to the intermediate member for pivoting about a primary lateral axis and reciprocating in the longitudinal direction relative to a secondary lateral axis, and having a restriction link pivotally attached to the foot pad and pivotally attached to the intermediate member for pivoting about the secondary lateral axis.

20. The foot pedal as recited in claim 16 wherein (i) the foot pad is attached to a longitudinally extending cam, (ii) the intermediate member is attached to at least one cam roller, and (iii) the cam roller reciprocates in the longitudinal direction and transverse directions along the cam.

21. The foot pedal as recited in claim 16 wherein (i) the foot pad is pivotally attached to a cam roller and a cam is attached to the intermediate member, (ii) the cam roller reciprocates along the cam in a longitudinal and transverse direction, and (iii) a restriction link is pivotally attached to the foot pad and pivotally attached to the intermediate member for pivoting about a lateral axis.

22. The foot pedal as recited in claim 16 wherein (i) the foot pad is pivotally attached to the intermediate member by a first link for pivoting about a first lateral axis and the foot pad is pivotally attached to the intermediate member by a second link for pivoting about a second lateral axis and (ii) the second lateral axis is longitudinally spaced from the first lateral axis.

23. The foot pedal as recited in claim 16 further comprising a base member wherein the intermediate member pivots about a lateral axis relative to the base member.

24. A skating simulator foot pedal comprising:

(a) an intermediate member;

(b) a foot pad pivotally attached to the intermediate member for pivoting about a primary lateral axis and reciprocating in the longitudinal direction relative to a secondary lateral axis; and (c) a restriction link pivotally attached to the foot pad and pivotally attached to the intermediate member for pivoting about the secondary lateral axis.

* * * * *